US008567692B2

(12) United States Patent
Coppersmith

(10) Patent No.: US 8,567,692 B2
(45) Date of Patent: Oct. 29, 2013

(54) OSCILLATING SPRINKLER AUTOMATICALLY PRODUCING EVENLY-SPACED RECTILINEAR WATERING AND A RECTANGULAR WATERING PATTERN

(76) Inventor: Eldon Coppersmith, Lakewood, CO (US)

( * ) Notice: Subject to any disclaimer, the term of this patent is extended or adjusted under 35 U.S.C. 154(b) by 339 days.

(21) Appl. No.: 12/917,667

(22) Filed: Nov. 2, 2010

(65) Prior Publication Data

US 2011/0101123 A1 May 5, 2011

Related U.S. Application Data

(60) Provisional application No. 61/257,756, filed on Nov. 3, 2009.

(51) Int. Cl.
*B05B 17/04* (2006.01)

(52) U.S. Cl.
USPC ..... 239/11; 239/242; 239/247; 239/562; 239/566; 239/602; 239/DIG. 1; 239/DIG. 12

(58) Field of Classification Search
USPC ..... 239/240, 242, 246, 247, 248, 562, 563, 239/566, 602, DIG. 1, DIG. 12, 11
See application file for complete search history.

(56) References Cited

U.S. PATENT DOCUMENTS

| | | | | |
|---|---|---|---|---|
| 2,952,413 | A * | 9/1960 | Ivar | 239/242 |
| 3,559,888 | A * | 2/1971 | Miklos | 239/242 |
| 3,647,140 | A | 3/1972 | Perrot et al. | |
| 4,721,248 | A | 1/1988 | Chow | |
| 5,305,956 | A | 4/1994 | Wang | |
| 5,350,115 | A | 9/1994 | Burnworth et al. | |
| 5,562,247 | A | 10/1996 | Roman | |
| 5,628,458 | A | 5/1997 | Kuo | |
| 5,657,928 | A | 8/1997 | Jian | |
| 6,062,490 | A | 5/2000 | Katzer et al. | |
| 6,135,356 | A | 10/2000 | Mitzlaff et al. | |
| 6,478,241 | B1 | 11/2002 | Guo | |
| 6,736,340 | B1 | 5/2004 | Wang | |
| 7,389,950 | B2 * | 6/2008 | Lo | 239/542 |
| 7,607,590 | B2 | 10/2009 | Nies | |
| 7,624,934 | B2 | 12/2009 | Breedlove et al. | |
| 2002/0092931 | A1 | 7/2002 | Coote | |
| 2006/0249595 | A1 | 11/2006 | Lipscomb et al. | |

FOREIGN PATENT DOCUMENTS

| | | | |
|---|---|---|---|
| CA | 2266247 | A1 | 3/1999 |

* cited by examiner

*Primary Examiner* — Steven J Ganey
(74) *Attorney, Agent, or Firm* — Kilpatrick Townsend & Stockton LLP

(57) ABSTRACT

A sprinkler includes an oscillating tube that receives water from a supply, and the tube oscillates about a longitudinal axis through a range of radial angles. A plurality of nozzles spaced along the oscillating tube distribute water generally upward and outward from the oscillating tube to create a water distribution pattern on the ground. The longitudinal angles of at least some of the nozzles are automatically selectively regulated as a function of the radial angle of the oscillating tube, controlling the impact locations on the ground of the water emanating from the respective nozzles. The longitudinal angles may be automatically regulated such that the water emanating from the respective nozzles reaches parallel, rectilinear, evenly-spaced impact locations on the ground. The ranges of radial angles traversed by at least some of the nozzles may be automatically regulated such that the ends of the water distribution pattern are rectilinear. A rectangular or square water distribution pattern may be thereby automatically produced.

23 Claims, 22 Drawing Sheets

CURRENT INVENTION

CURRENT INVENTION

CURRENT INVENTION (Prior Art Sprinkler)

OSCILLATING SPRINKLER AUTOMATICALLY PRODUCING EVENLY-SPACED RECTILINEAR WATERING AND A RECTANGULAR WATERING PATTERN

This application claims the benefit of U.S. Provisional Application No. 61/257,756, filed on Nov. 3, 2009 and titled "Oscillating Sprinkler Automatically Producing Evenly-Spaced Rectilinear Watering and a Rectangular Watering Pattern", the disclosure of which is hereby incorporated herein by reference in its entirety.

BACKGROUND OF THE INVENTION

This invention generally relates to outdoor lawn sprinklers and portable watering systems.

Many people use the common, inexpensive, portable oscillating sprinkler to water their front and back yards and gardens. The first such sprinkler was apparently produced in the late 1940s. Oscillating sprinklers produce elliptical water distribution patterns incompatible with typical orthogonal, rectilinear, rectangular shaped front and back residential yards. I was inspired to invent an embodiment of the oscillating sprinkler that produces a rectangular water distribution pattern when I experienced the aggravating and inefficient, time-consuming task of separately watering the corner areas of my own yard, particularly after I had planted bushes around the perimeter of my back yard. I was further inspired when I observed the waste water produced by the elliptical water distribution pattern of prior art sprinklers distributing water beyond typical rectilinear boundaries of areas being watered in my front yard, and throughout all of metro Denver, Colo. I was further inspired when I observed the run-off waste water running off of driveways and streets and running down the streets of town into the storm sewers. I was further inspired when I realized that this run-off waste water was conveying fertilizer and herbicides, etc. into lakes, streams, and rivers, etc. I was further inspired when I realized that precious fresh water was being wasted in parts of the country and world with water shortages and times of drought. I was further inspired when I began conducting experiments with prior art sprinklers and realized that the sprinklers were delivering substantially more water to the "ends" of their elliptical water distribution pattern than to the "middle area" of the ellipse. My neighbor stated "you have to waste some water to get the corners." On Aug. 15, 2008 I filed a patent application entitled "Oscillating Sprinkler That Automatically Produces A Rectangular Water Distribution Pattern." In general, this disclosure describes embodiments additional to those in "Oscillating Sprinkler That Automatically Produces A Rectangular Water Distribution Pattern," and describes embodiments that perform functions additional to those performed by the embodiments in "Oscillating Sprinkler That Automatically Produces A Rectangular Water Distribution Pattern."

Water is supplied to a prior art oscillating sprinkler from a standard faucet and hose. These sprinklers typically consist of a base structure on which is mounted a water motor and an oscillating tube with a plurality of nozzles. The tube oscillates back and forth along its longitudinal axis powered by the flow of water through the water motor. In order to water areas wider than the length of the tube, directional streams must be produced so that for example, an oscillating tube 12 inches in length may produce a water distribution pattern for example 40 feet wide at the widest point of its generally elliptical water distribution pattern. Directional streams are produced either by using a curved tube as in U.S. Pat. No. 4,721,248 or else by placing the nozzles at longitudinally outward angles on a straight tube as in U.S. Pat. No. 6,062,490. In general, if a prior art oscillating sprinkler is located where the water will reach the corners, then much of the water falls outside of a typical rectangular area being watered between the corners, and is waste water and/or run-off waste water. If the sprinkler is located where it will not produce waste water and/or run-off waste water, then the corner areas do not receive water.

MANUAL adjustments are available on many PRIOR ART oscillating sprinklers which can cause the water distribution pattern to be a full-sized ELLIPSE, an ELLIPSE smaller than the full-size that the sprinkler is capable of producing, a partial ELLIPSE, a long narrow ELLIPSE, or a short wide ELLIPSE, but they are all nonetheless ELLIPTICAL. THIS IS DESPITE THE DIAGRAMS OF "RECTILINEAR" AND "RECTANGULAR" WATERING PATTERNS AND THE USE OF THE WORD "RECTANGULAR" ON PRIOR ART SPRINKLER PACKAGING AT THE STORE, ON WEB SITES, IN PUBLICATIONS, AND PATENTS, ETC.

All information provided in this writing, and all information provided in the patent application entitled "Oscillating Sprinkler That Automatically Produces A Rectangular Water Distribution Pattern," which I filed on Aug. 15, 2008, regarding any embodiment and/or any variation and/or any combination thereof may be considered to be applicable to all embodiments and/or variations and/or all combinations thereof. That prior application, U.S. patent application Ser. No. 12/192,689, now U.S. Pat. No. 8,011,602 issued Sep. 6, 2011, is hereby incorporated herein by reference for all purposes.

BRIEF DESCRIPTION OF THE DRAWINGS

The drawings are exemplary. The drawings may not be accurately to scale.

Whereas in general, some of the drawings provide generalized information regarding embodiments of the invention, FIG. 3 generally refers to an embodiment of the current invention, FIGS. 3*a* through 12 generally refer to another embodiment of the current invention, and FIGS. 16 through 19 generally refer to another embodiment of the current invention.

For simplicity, many of the drawings do not show the water motor and none of the drawings show the oscillation mechanism which connects the water motor to the oscillating tube, however it is to be understood by one skilled in the art that embodiments of the current invention have a water motor and some sort of an oscillation mechanism with adjustable stops.

For simplicity and clarity, in most of the drawings regarding FIGS. 3*a* through 12, the longitudinal and radial angle regulators are shown as individual components. However, the regulators may be reinforced and strengthened, manufactured more easily, etc. by being interconnected by supportive parts that may interconnect some or all of the regulators into a single unitary grid, for example. The regulators, individual or interconnected, may be attached to the base structure and/or elsewhere as is desirable.

For simplicity and clarity, most of the drawings depict nine nozzles, however it is likely that there may be more than nine nozzles on a sprinkler embodying the invention.

Figure 1A:
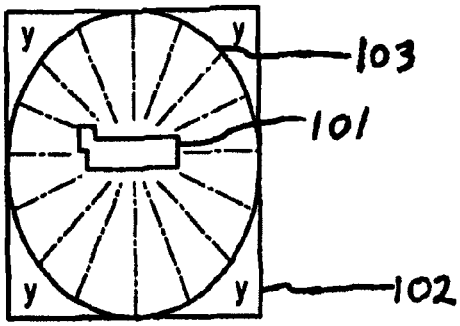
PRIOR ART FIG.1a

FIGS. 1*a, b*, and *c* are exemplary top views of rectangular areas to be watered and the geometric incompatibility of the elliptical water distribution pattern of a prior art sprinkler, the areas of waste water and/or run-off waste water, and corner areas that may not receive water.

Figure 2A:
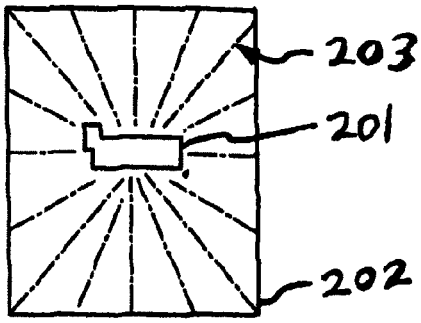

FIGS. 2*a, b*, and *c* are exemplary top views of rectangular areas to be watered and the geometric compatibility and efficiency of the rectangular water distribution pattern generated by a sprinkler embodying the invention.

Figure 3:
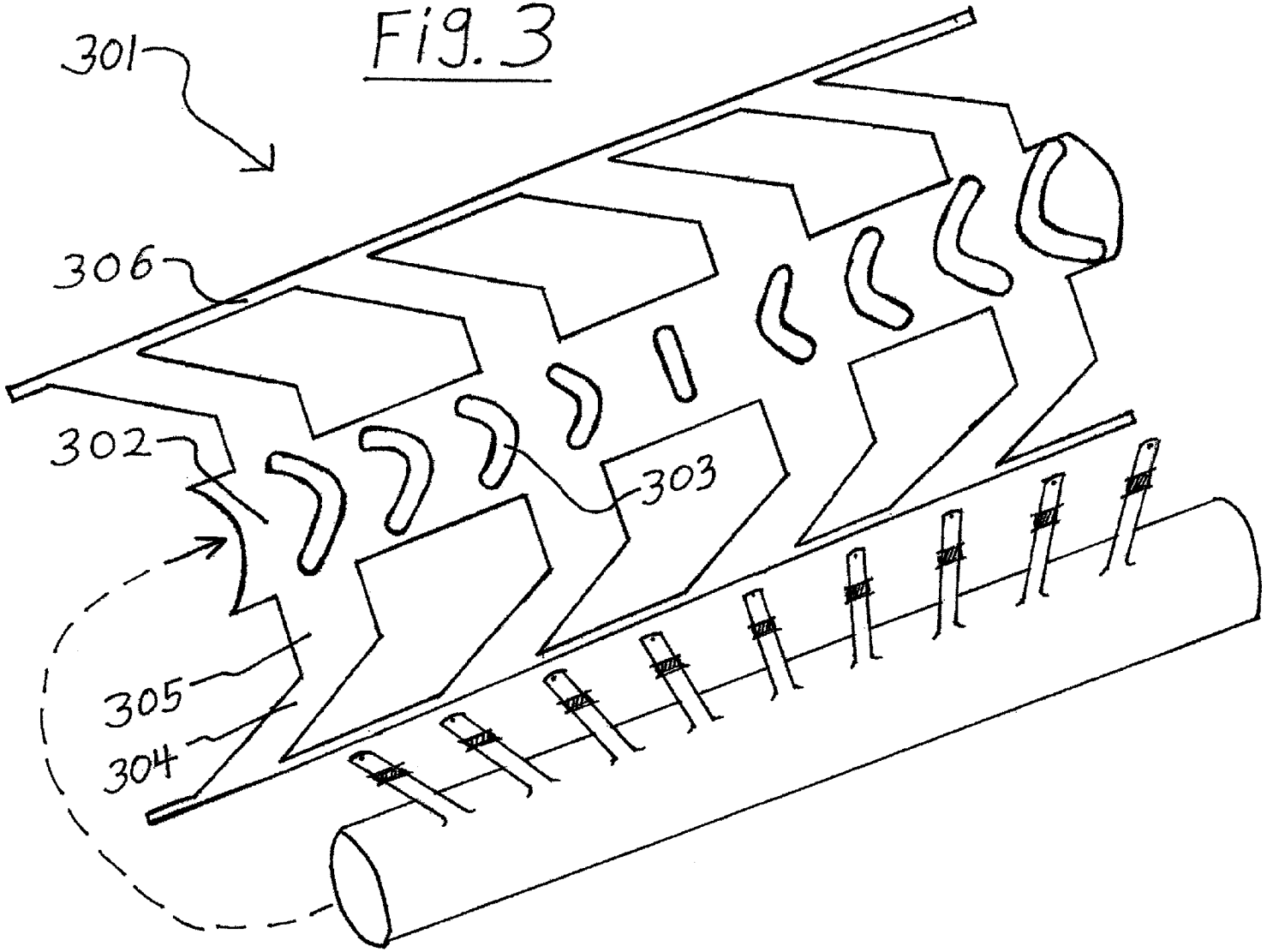

FIG. 3 is a perspective view of a unitary body comprising regulatory channels which regulate both the longitudinal and the radial angles of relatively long flexible nozzles as the oscillating tube oscillates. This regulation enables the oscillating sprinkler to automatically produce a rectangular water distribution pattern with parallel evenly-spaced rectilinear impact locations of water on the ground throughout the length of the rectangular water distribution pattern.

Figure 3A:
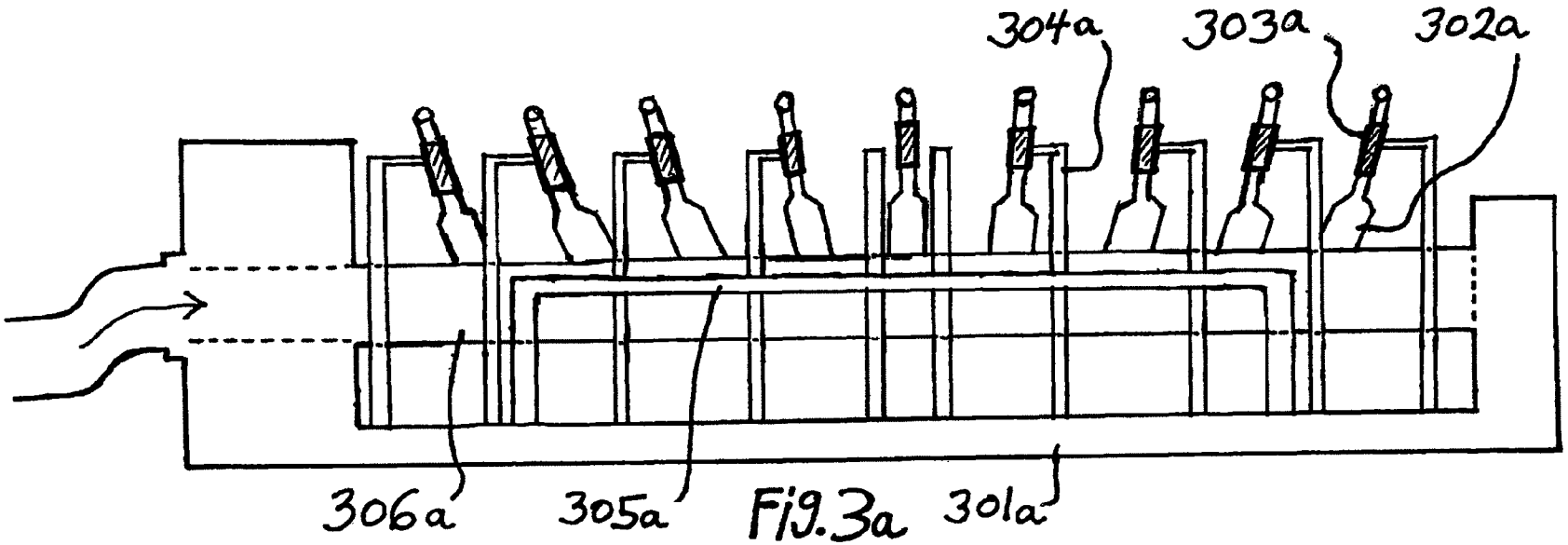

FIG. 3*a* is a side view of a sprinkler according to embodiments of the invention with flexible nozzles in a vertical oscillating position, rigid, slick contact receptors, curved longitudinal angle regulators, and curved radial angle regulators. FIG. 3*a* exemplifies curved radial angle regulators of a length such that they do not contact the end-most nozzles.

Figure 4:
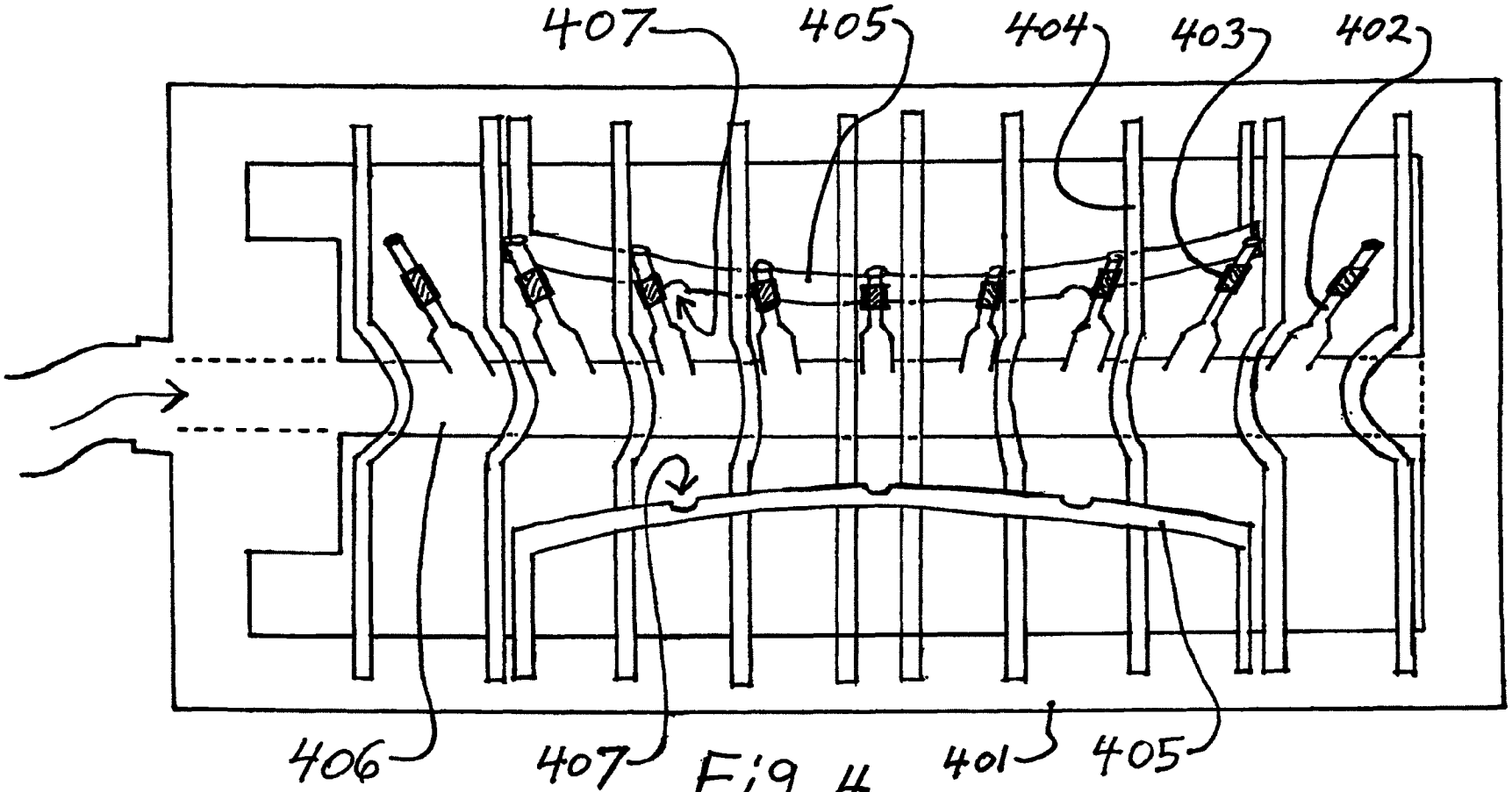

FIG. 4 is a top view of a sprinkler according to embodiments of the invention showing flexible nozzles near a horizontal-most oscillating position, curved longitudinal angle regulators, and curved radial angle regulators. FIG. 4 exemplifies curved radial angle regulators with optional indentations for contacting odd-numbered nozzles.

Figure 4A:
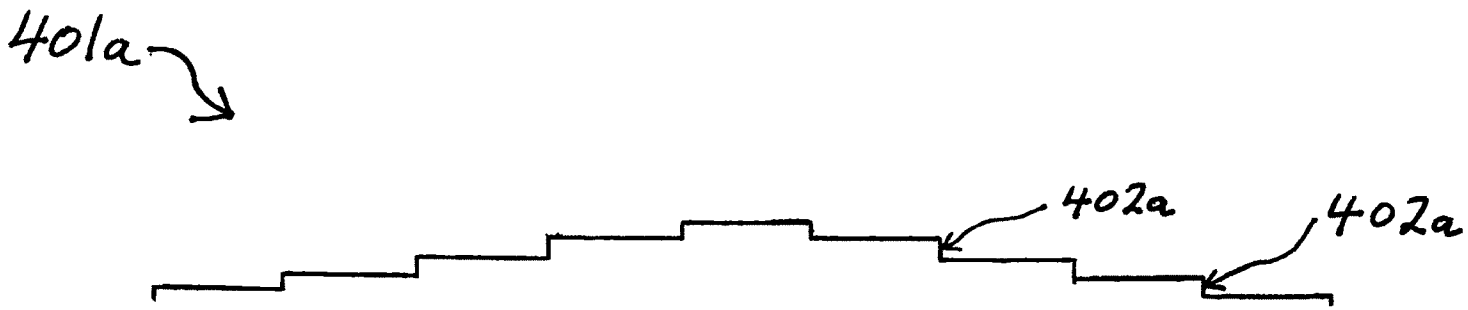

FIG. 4*a* is a top view of the leading edge of a stepped radial angle regulator. A stepped radial angle regulator is an alternative to a curved radial angle regulator with or without indentations.

Figure 5:
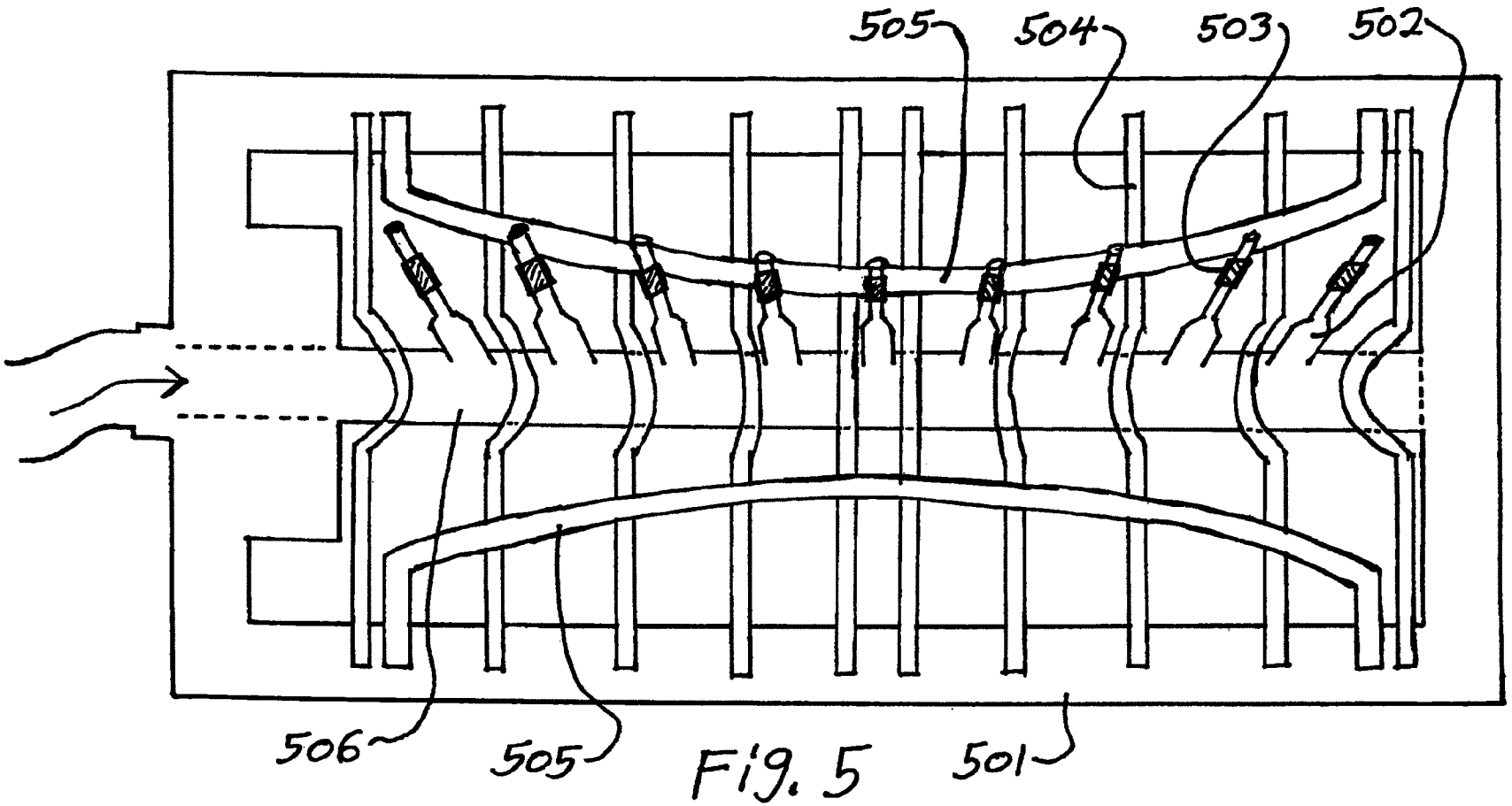

FIG. 5 is a top view of a sprinkler according to embodiments of the invention showing radial angle regulators of a length sufficient to contact the end-most nozzles when the oscillating tube reaches its horizontal-most position, a position of approximately 45 degrees, for example. FIG. 5 shows the oscillating tube in a position midway between vertical and horizontal-most, with the nozzles not in contact with the radial angle regulator at this point.

Figure 6A:
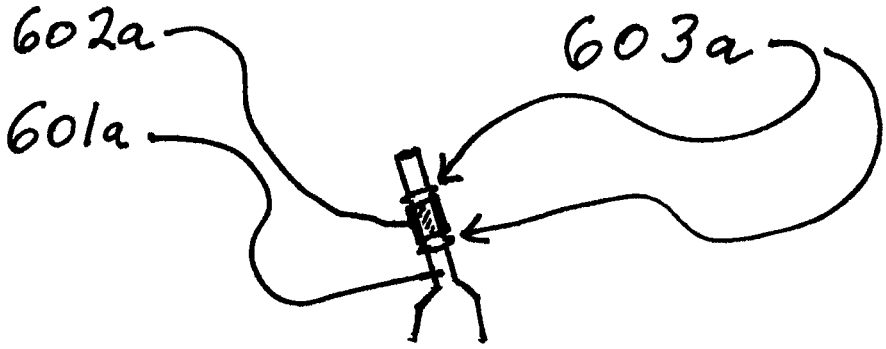

FIG. 6*a* is a side view of a flexible nozzle constructed so as to have definite longitudinal and radial angles when unregulated. The angles may be regulated by longitudinal and radial angle regulators. Also shown are flexible circumferential ridges between which is confined a rigid, slick contact receptor.

Figure 6B:
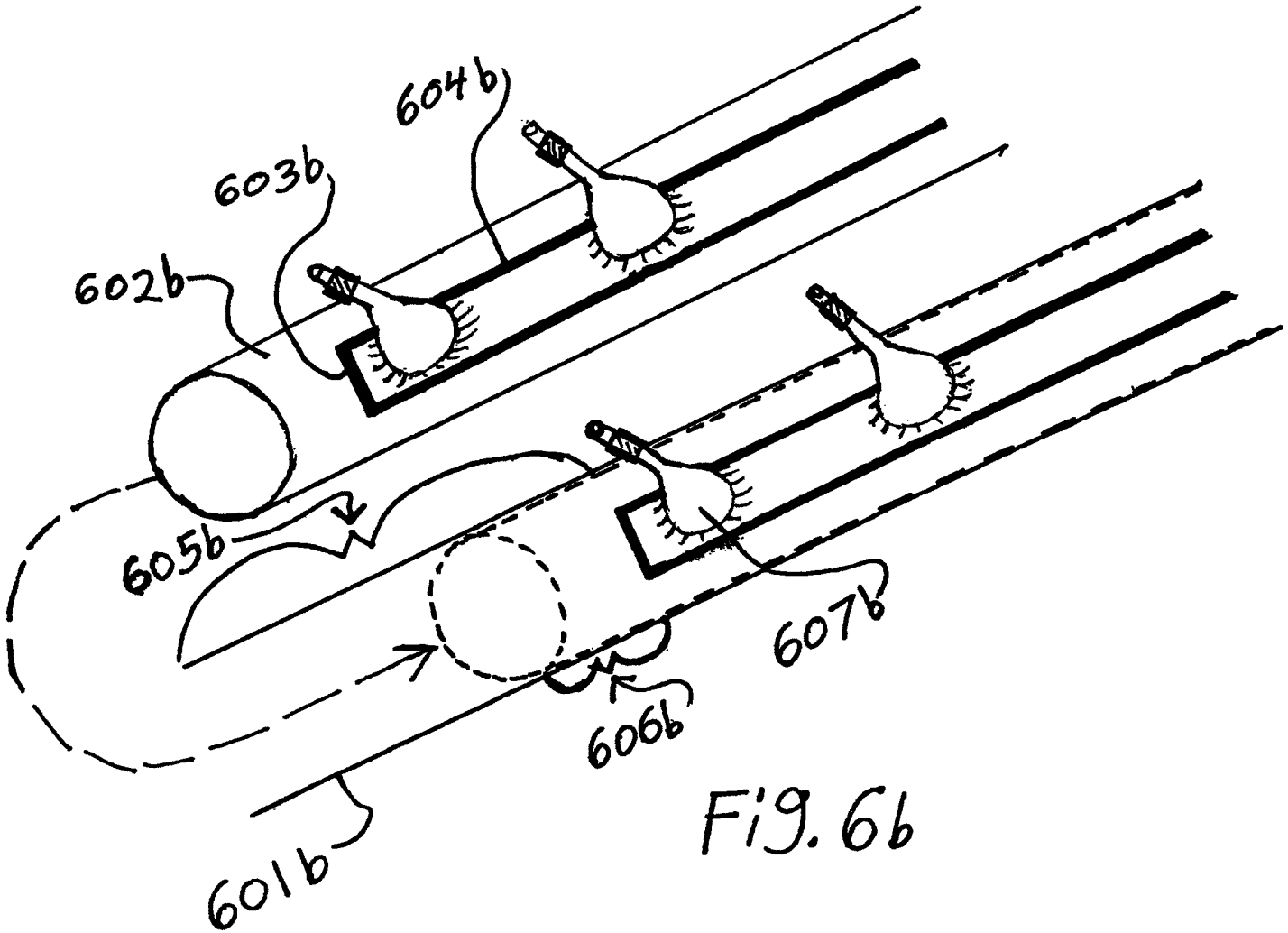

FIG. 6*b* is a perspective view showing that a flexible tube comprising flexible nozzles may be disposed water-tight, inside of a rigid tube with an opening out of which the nozzles may extend.

Figure 7:
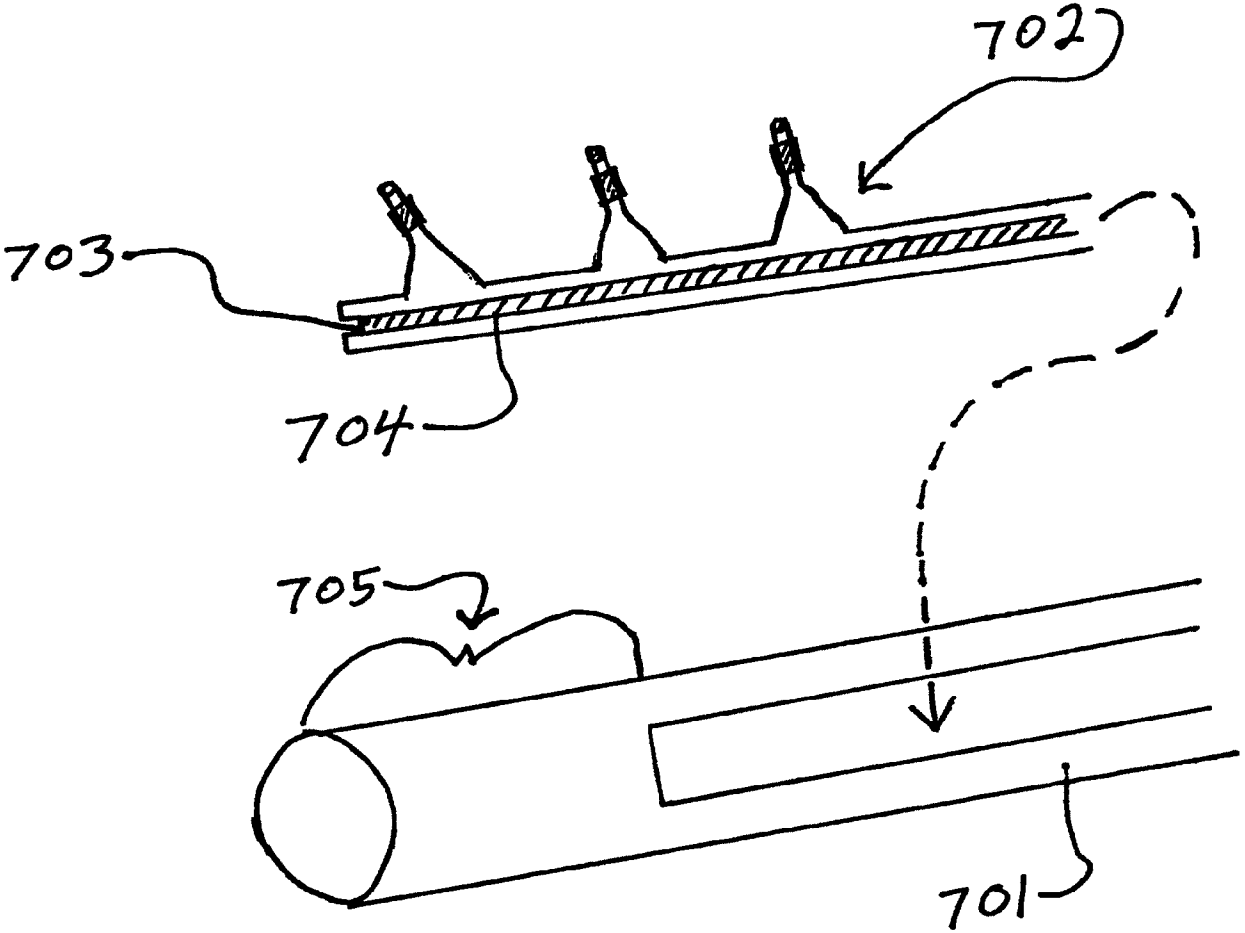

FIG. 7 is a perspective view showing that flexible nozzles on a flexible base may be disposed water-tight, on a rigid tube with an opening.

Figure 8:
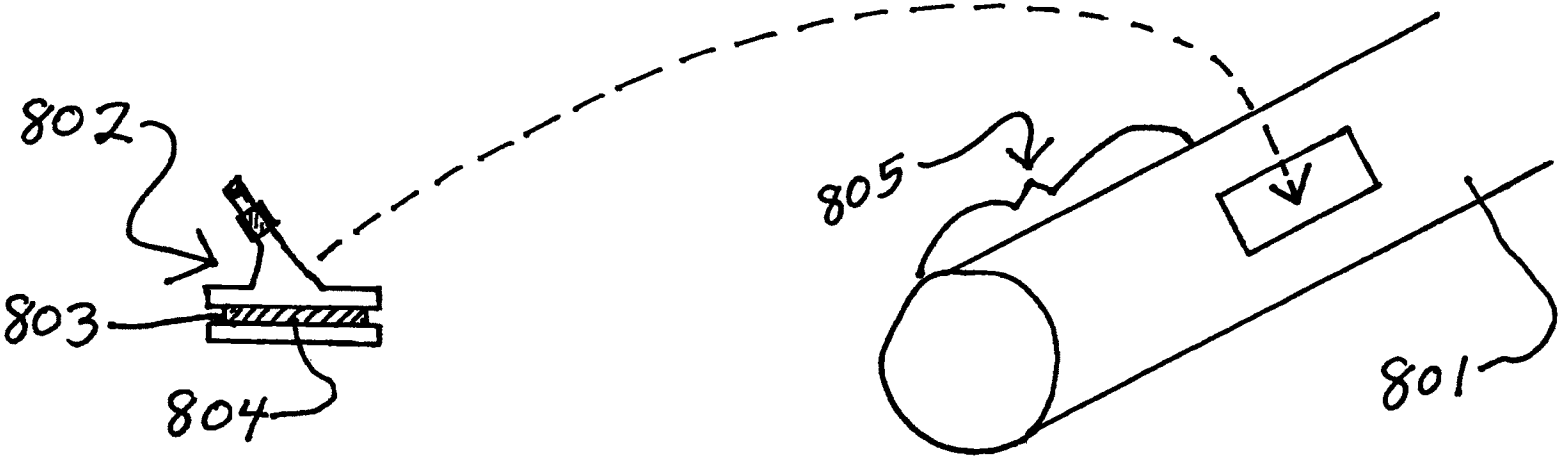

FIG. 8 is a perspective view showing that individual flexible nozzles on a flexible base may be disposed water-tight, on a rigid tube with openings.

Figure 9A:
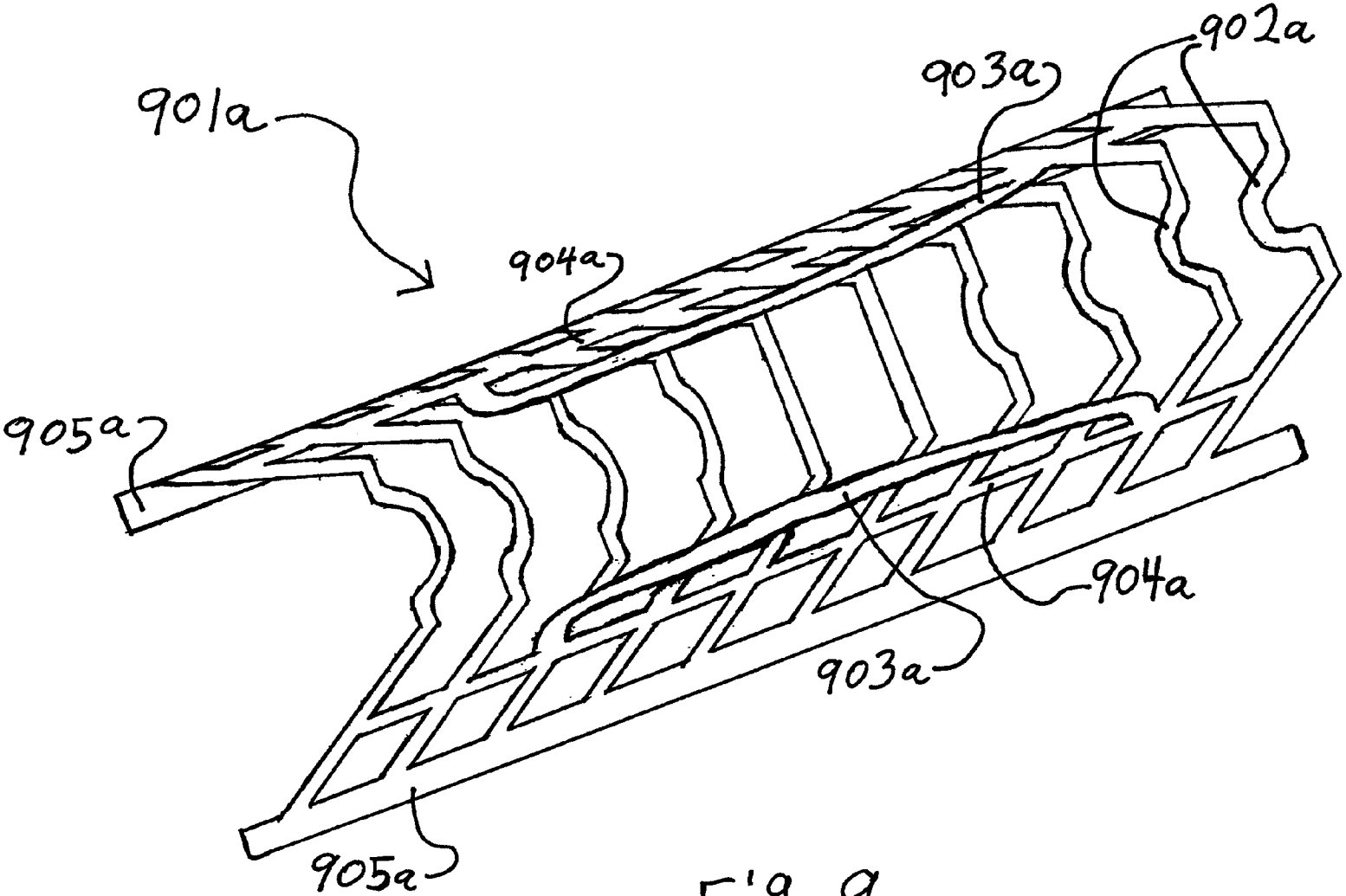

FIG. 9*a* is a perspective view of an exemplary unitary grid comprising curved longitudinal angle regulators, curved radial angle regulators, end-to-end reinforcing portions, and a portion which is attachable to the base structure. It shows that the entire unitary grid may be made of a single piece of material.

Figure 9B:
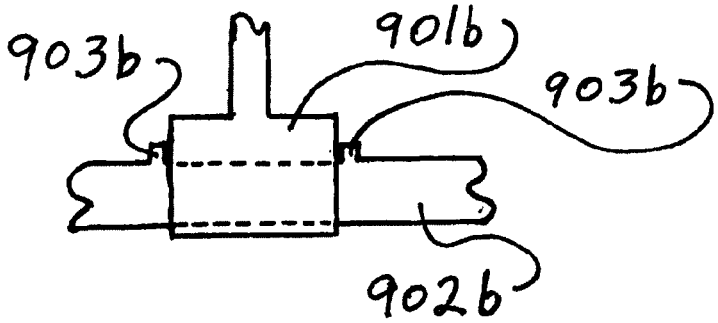

FIG. 9*b* is an exemplary side view showing exemplary ridges on the base structure which may function to precisely position a portion of the unitary grid attachable to the base structure. The attachable portion may frictionally "snap-on" to the base structure.

Figure 9C:
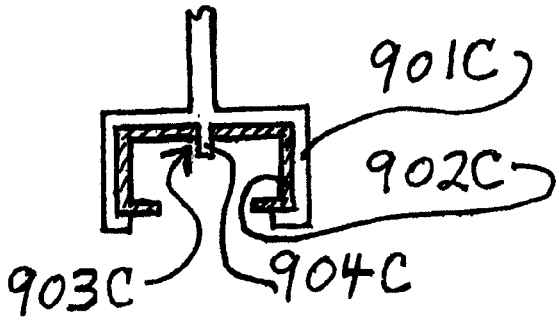

FIG. 9*c* is an exemplary end view of base structure with exemplary slot through which a tab on the attachable portion of a unitary grid may extend, functioning to precisely position a portion of the unitary grid attachable to the base structure. The attachable portion may frictionally "snap on" to the base structure.

Figure 9D:
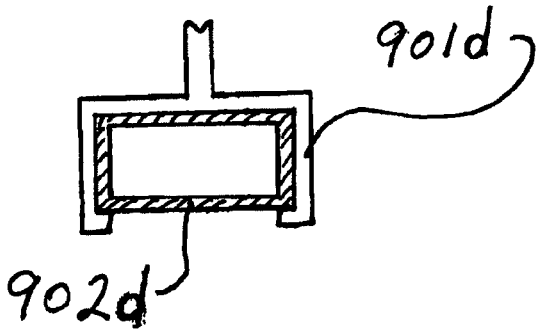

FIG. 9*d* is an exemplary end view of base structure and attachable portion of a unitary grid which may frictionally "snap on" to the base structure.

Figure 9E:
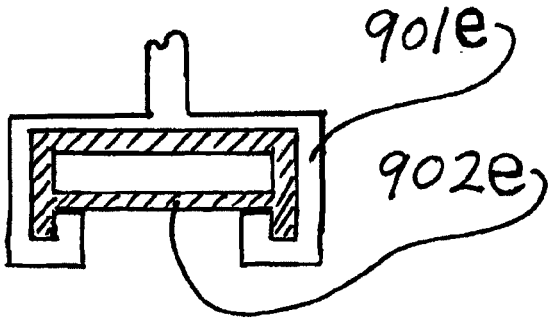

FIG. 9*e* is an exemplary end view of base structure and attachable portion of a unitary grid which may frictionally "snap on" to the base structure.

Figure 10:
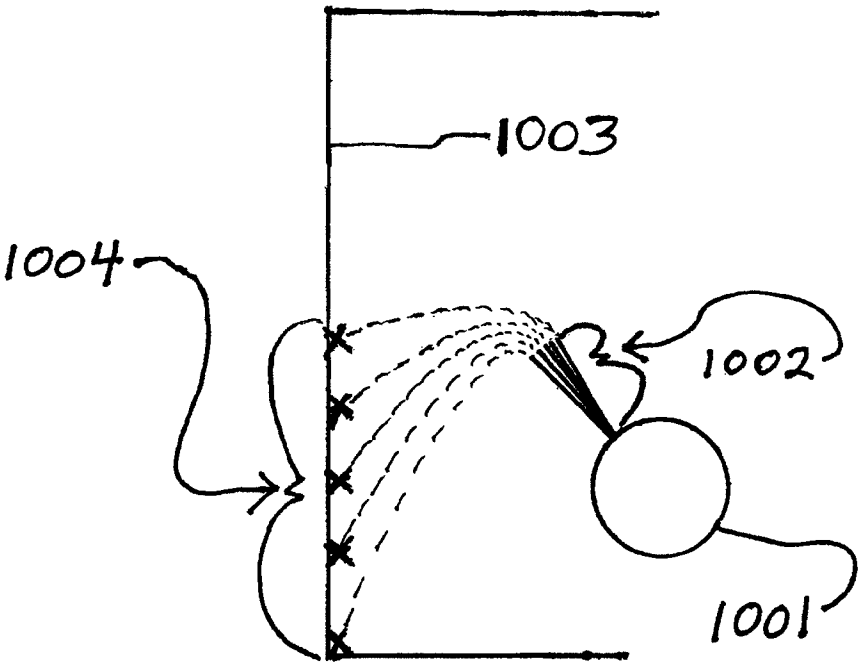

FIG. 10 is an end view of a sprinkler according to embodiments of the invention with its oscillating tube in a horizontal-most position, linear representations of five proximal flexible nozzles with their radial angles being regulated (by radial angle regulator, not shown), a rectilinear widthwise boundary and the corners of a rectangular area to be watered, and rectilinear impact locations of streams of water along the rectilinear boundary.

Figure 11:
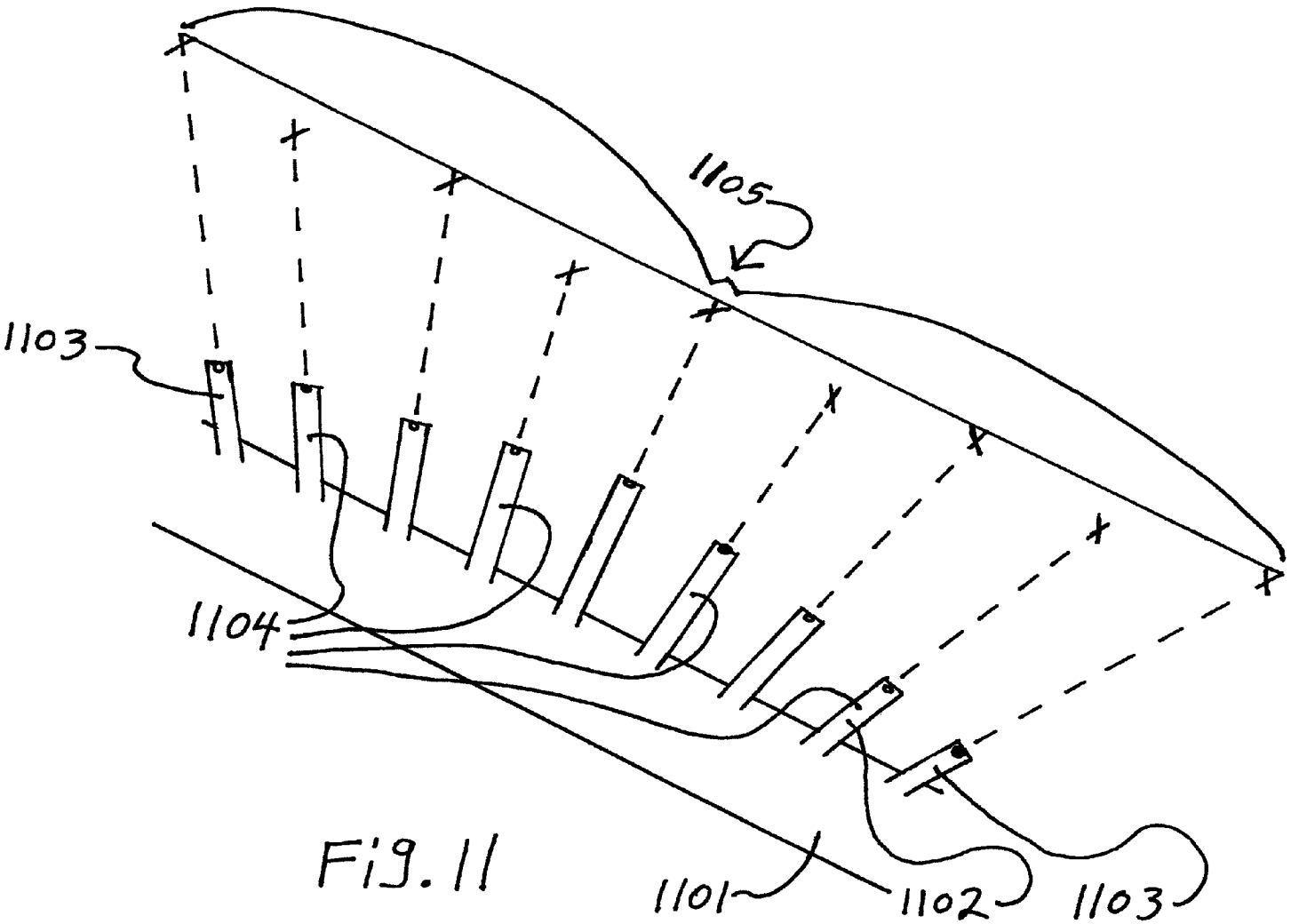

FIG. 11 is a perspective view of a sprinkler according to embodiments of the invention with its oscillating tube in a horizontal-most position, flexible nozzles, end-most nozzles optimally radially angled for maximal stream distance, and nozzles other than end-most nozzles with their radial angles being regulated (by radial angle regulator, not shown). FIG. 11 exemplifies the option of radially angling even-numbered nozzles slightly additionally "higher" in order to produce the option of staggered impact locations of streams of water rectilinearly along the rectilinear widthwise boundary of a rectangular area to be watered.

Figure 12:
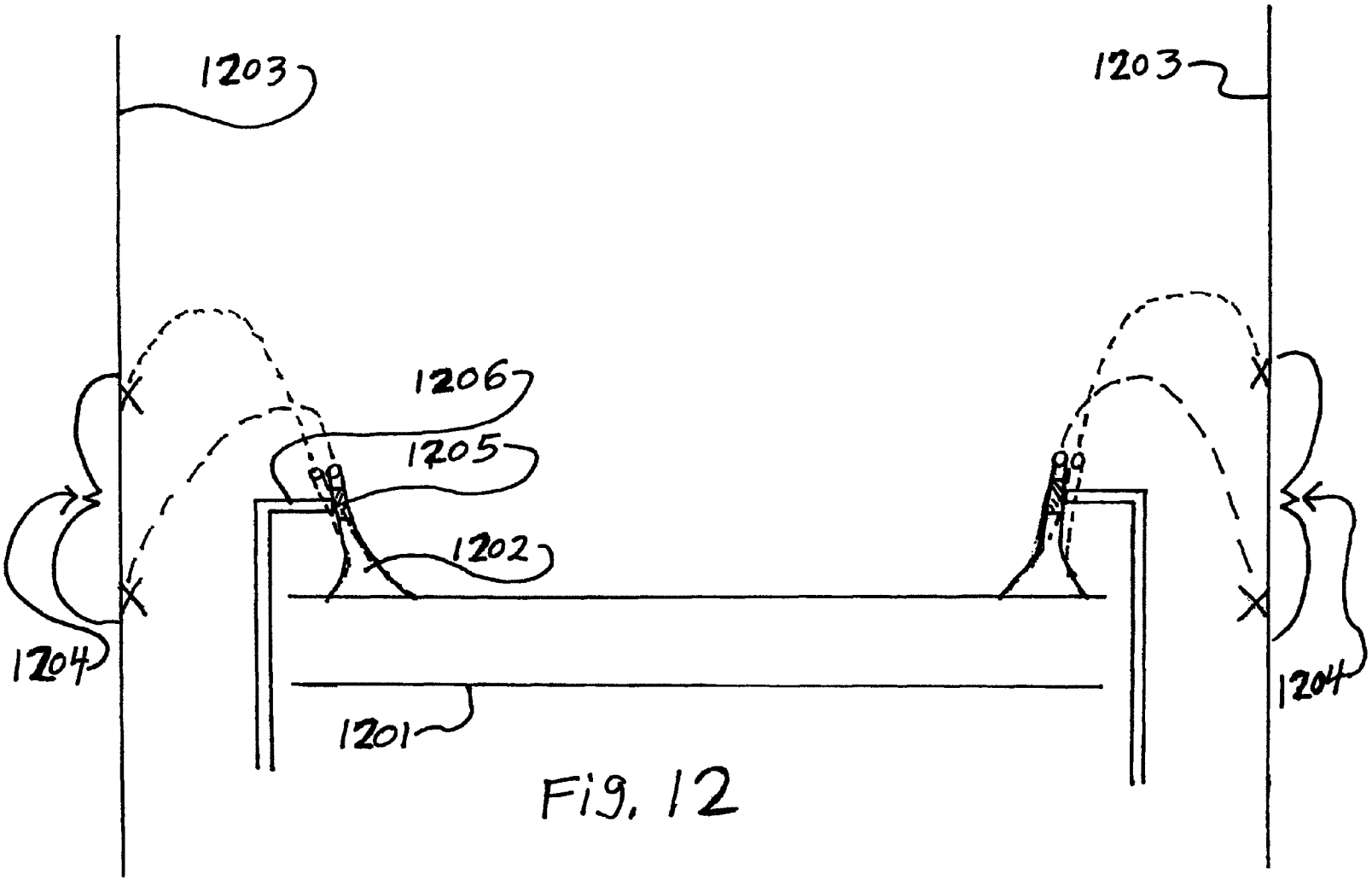

FIG. 12 is a side view of a motion-imparting time-lag representation of the oscillating tube of a sprinkler according to embodiments of the invention, with flexible nozzles oscillating toward a vertical position. (Only the end-most nozzles are shown). The flexible nozzles are shown in contact with and traversing their corresponding curved longitudinal angle regulators. The progressive change in the longitudinal angle of the flexible nozzles causes rectilinear impact locations of streams of water along the rectilinear lengthwise boundary of the rectangular area to be watered.

Figure 13:
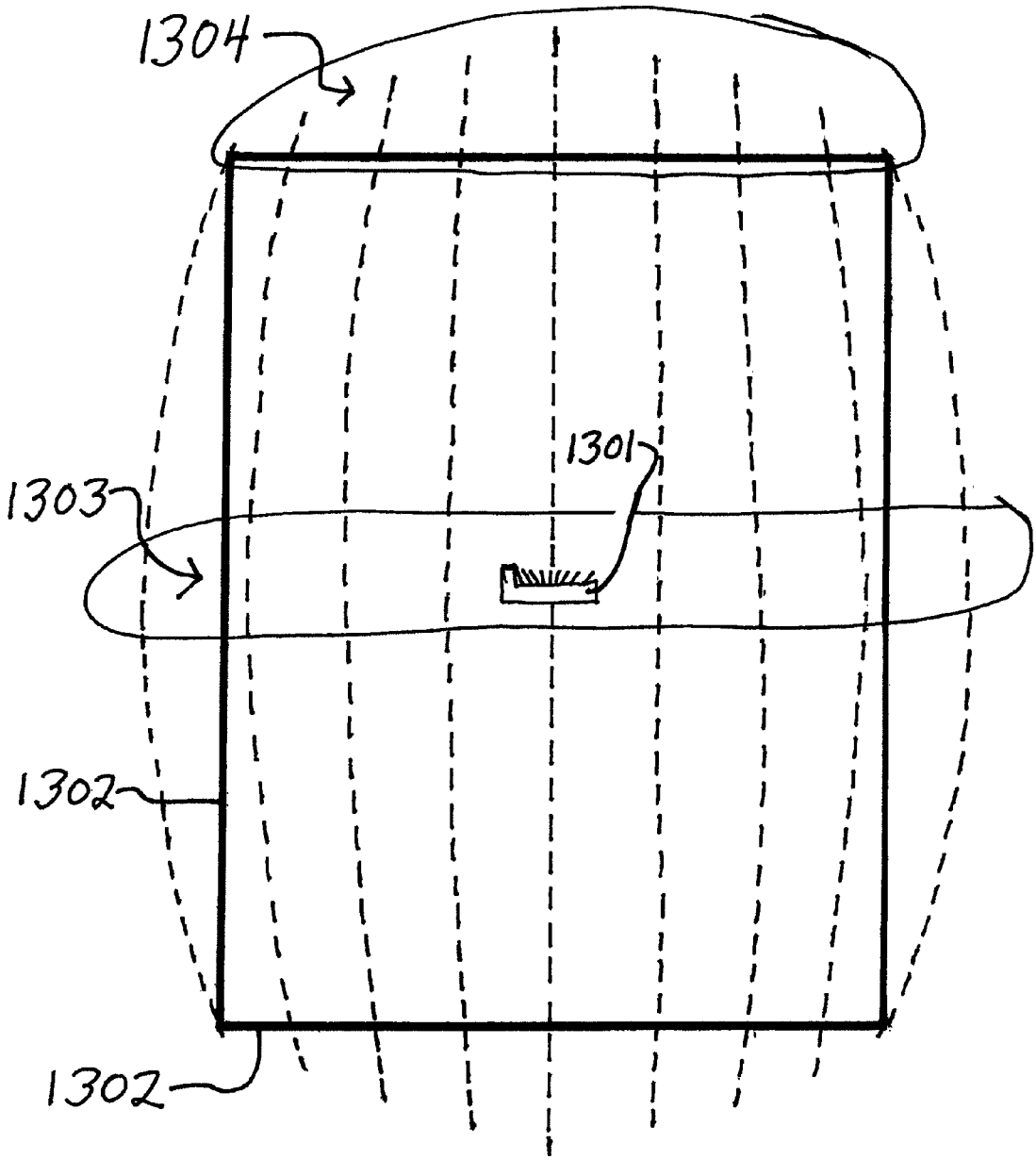

FIG. 13 is a top view of the impact locations of streams of water and the elliptical water distribution pattern of a prior art oscillating sprinkler superimposed over a rectangular area to be watered. Waste water and/or run-off waste water are shown as impact locations of streams of water outside of the rectilinear widthwise and lengthwise boundaries. Additionally, unevenness in the amount of water distributed to a given square foot of area is shown by comparison of the narrowly-spaced impact locations at and/or near the ends of the elliptical water distribution pattern to the widely-spaced impact locations at and/or near the center section of the elliptical water distribution pattern.

Figure 14:
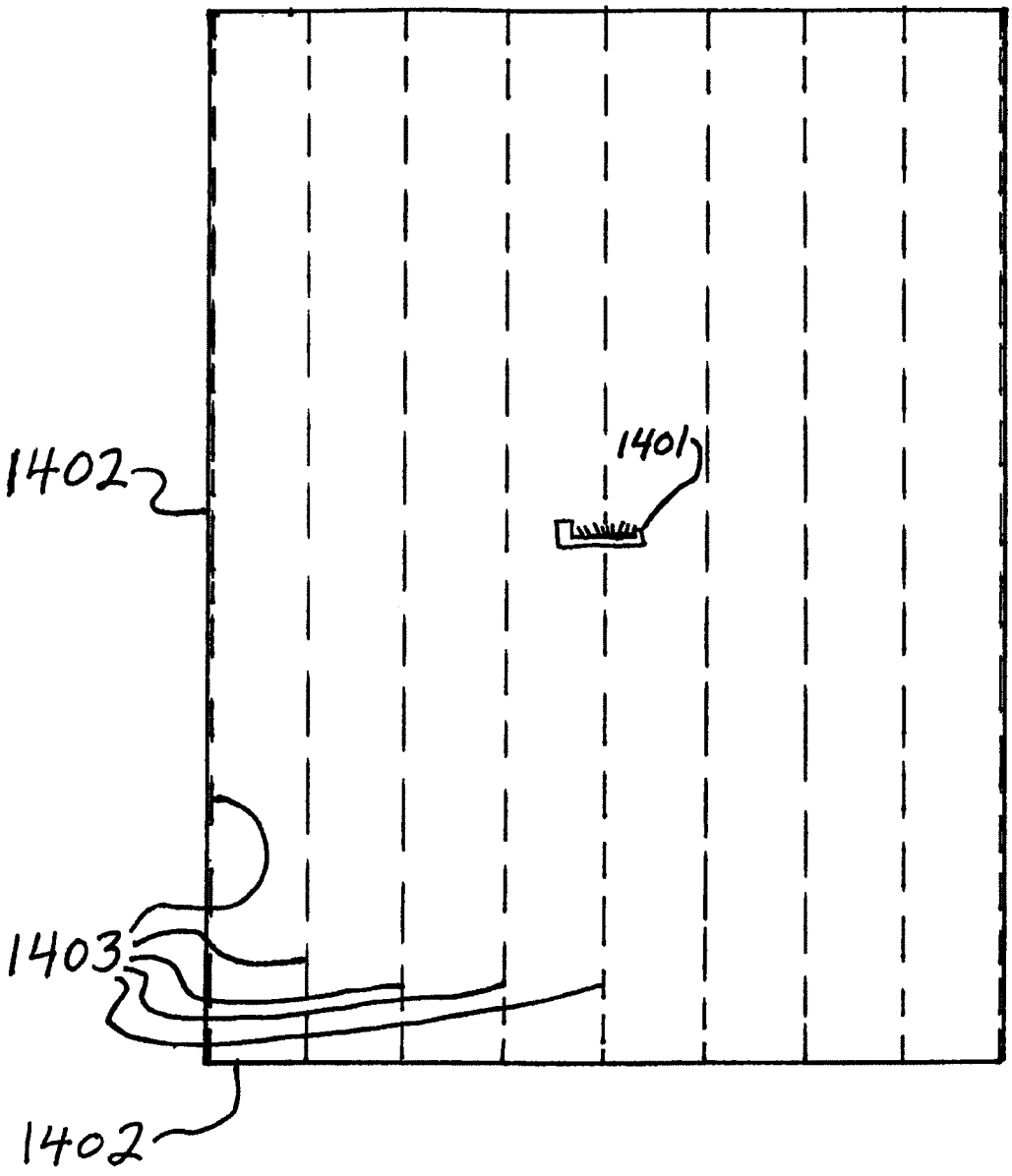

FIG. 14 is a top view of the impact locations of streams of water and the rectangular water distribution pattern of an oscillating sprinkler in accordance with embodiments of the invention, superimposed over a typical rectangular area to be watered. Parallel evenly-spaced rectilinear impact locations of streams of water and evenness in the amount of water distributed to any given square foot of area are shown.

Figure 15:
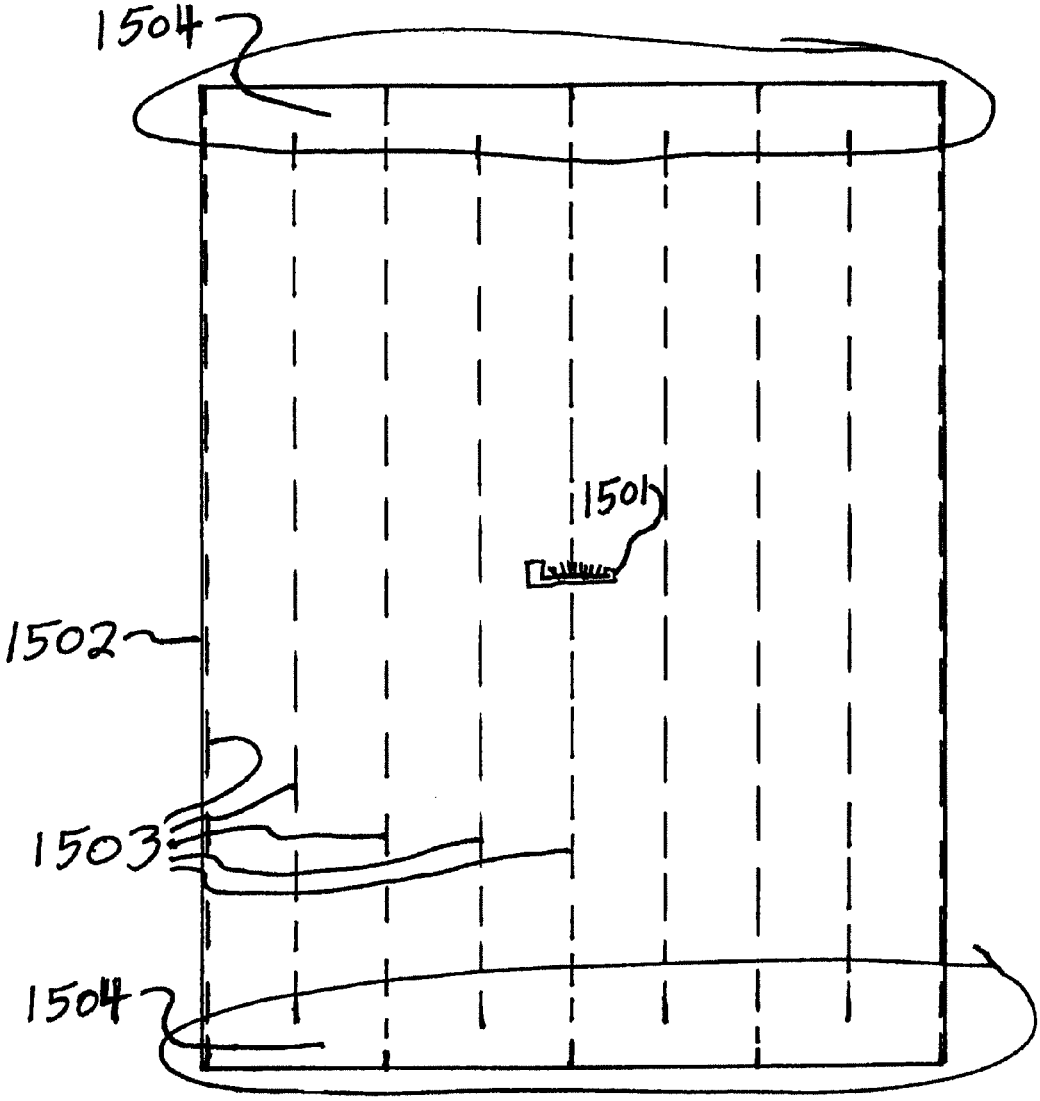

FIG. 15 is a top view of a rectangular area to be watered with generally the same information as FIG. 14, however, it also depicts optional staggered impact locations along the rectilinear widthwise boundaries, available with a sprinkler embodying the invention.

Figure 16:
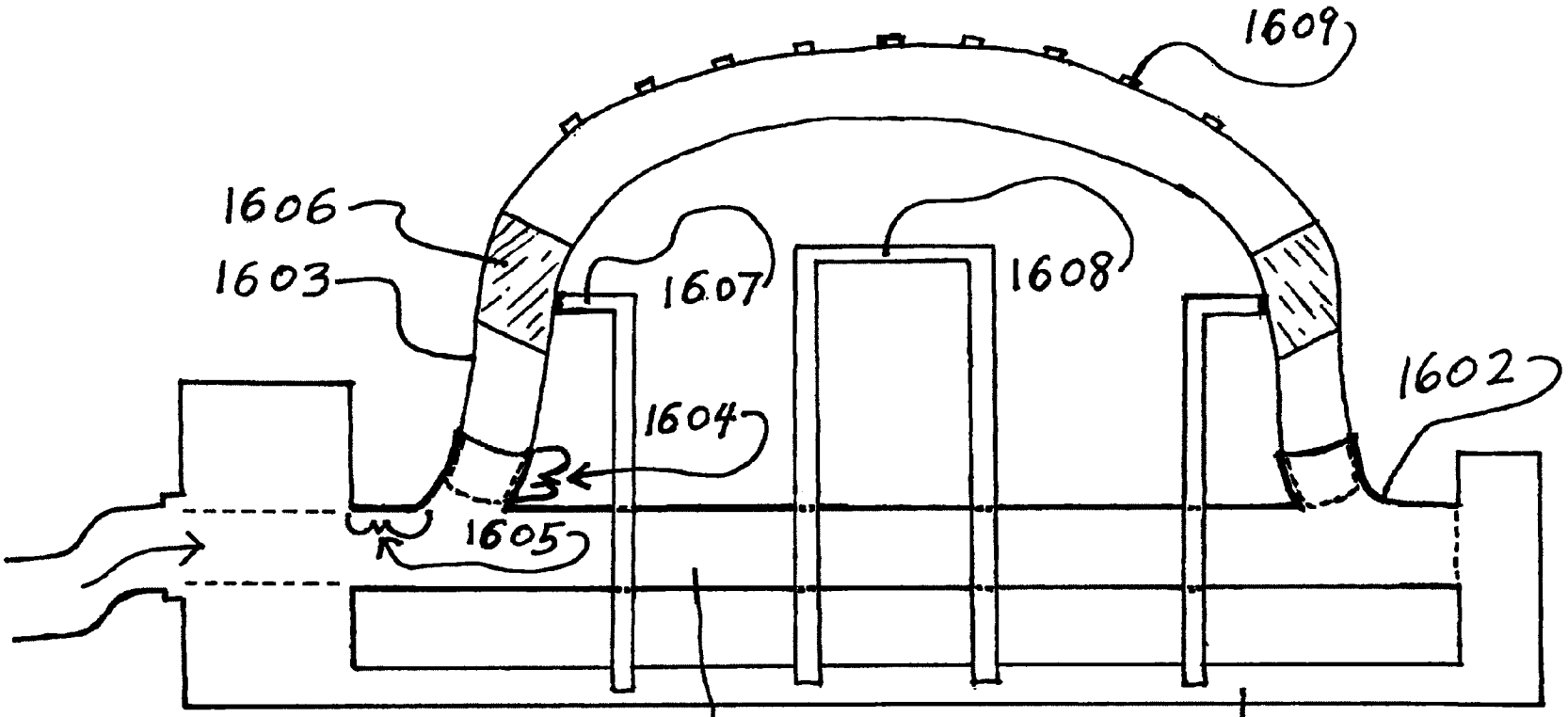

FIG. 16 is a side view of a sprinkler according to embodiments of the invention showing the ends of a flexible tube disposed inside of a bifurcated rigid oscillating tube in a vertical position, rigid, slick contact receptors, curved longitudinal angle regulators, and curved radial angle regulators. The flexible tube is shown in contact with curved longitudinal angle regulators.

Figure 17:
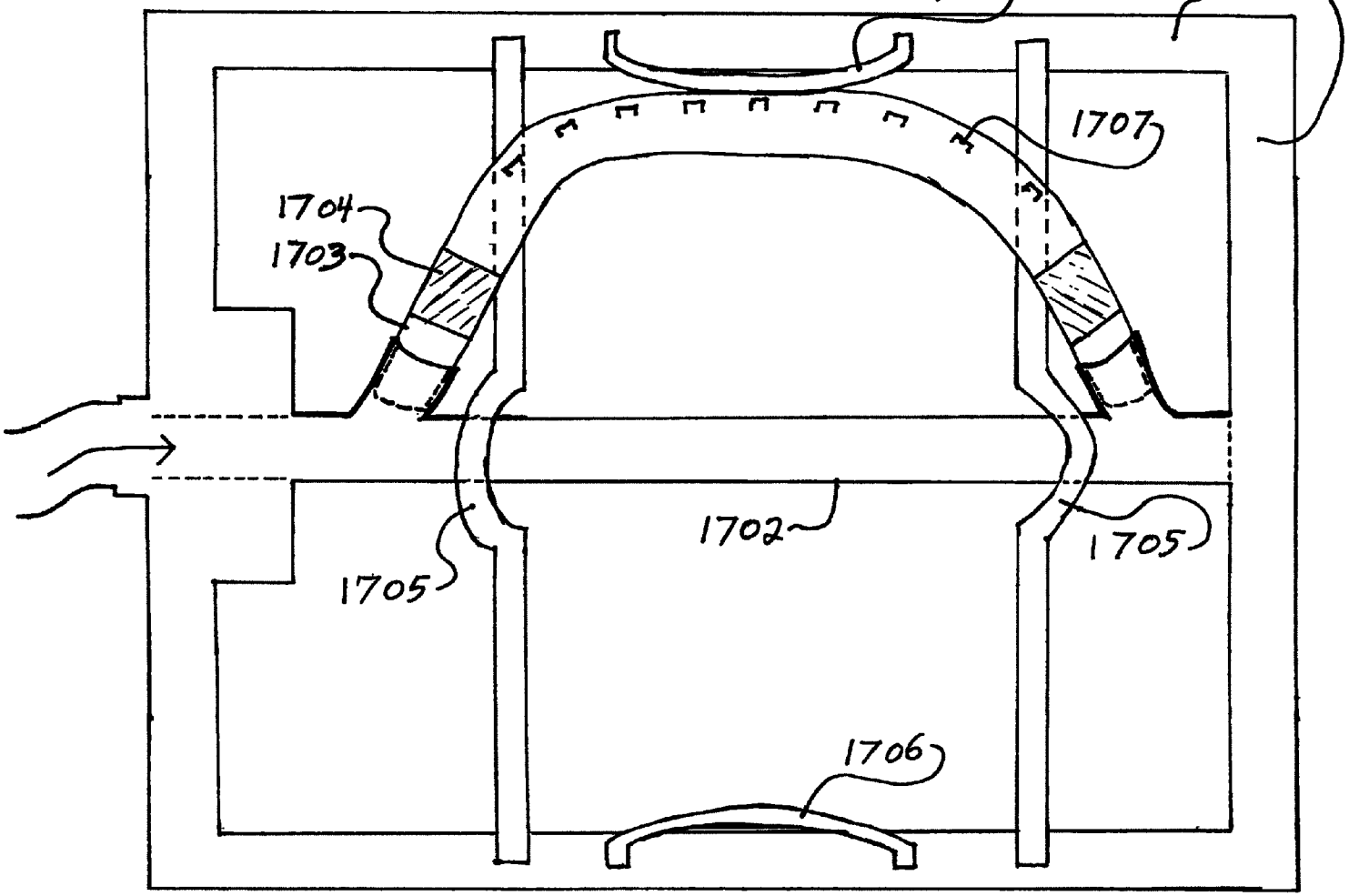

FIG. 17 is a top view of a sprinkler according to embodiments of the invention showing a bifurcated rigid oscillating tube in a horizontal-most position and a flexible tube in contact with a curved radial angle regulator.

Figure 18:
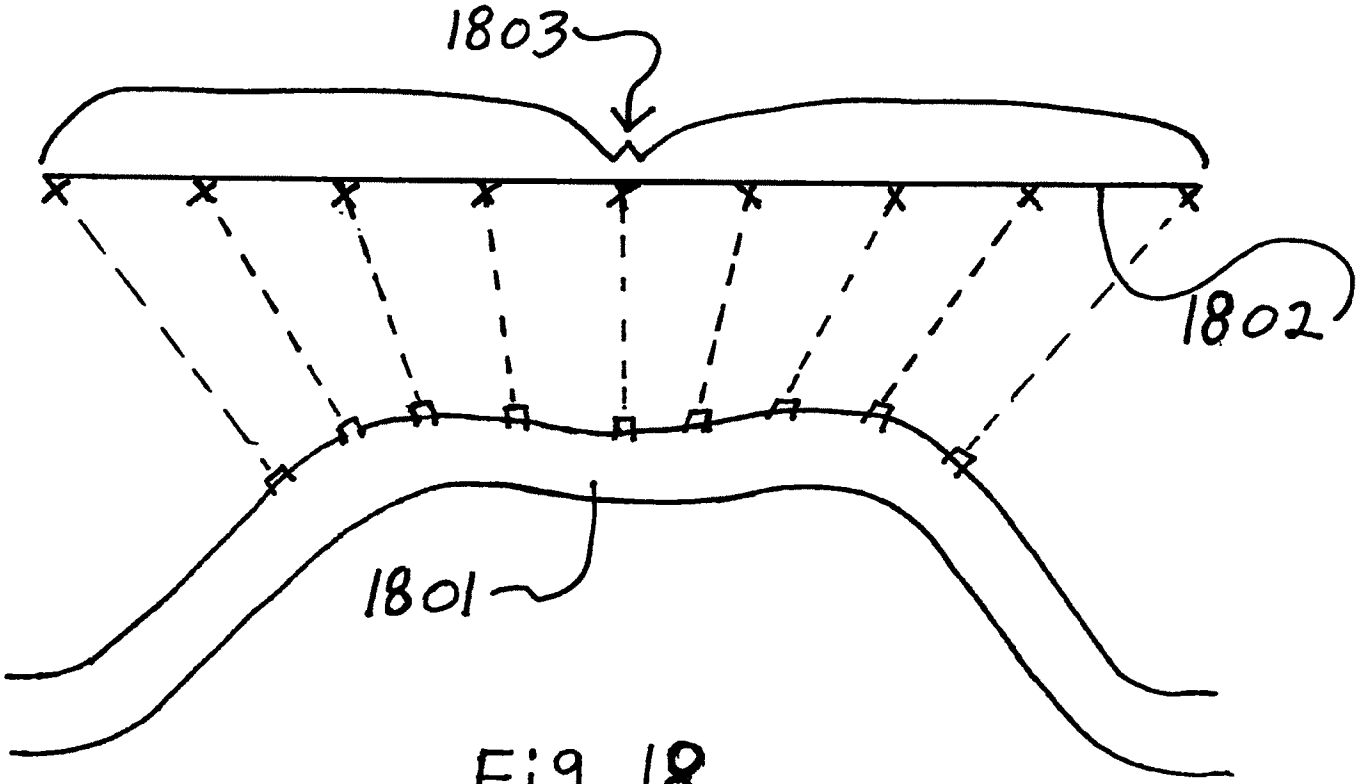

FIG. 18 is a side view of the flexible tube of a sprinkler according to embodiments of the invention in a horizontal-most position, end-most nozzles optimally radially angled for maximal stream distance, nozzles other than end-most nozzles with their radial angles being regulated (by curved radial angle regulator, not shown), and rectilinear impact locations of streams of water along the rectilinear widthwise boundary of a rectangular area to be watered.

Figure 19:
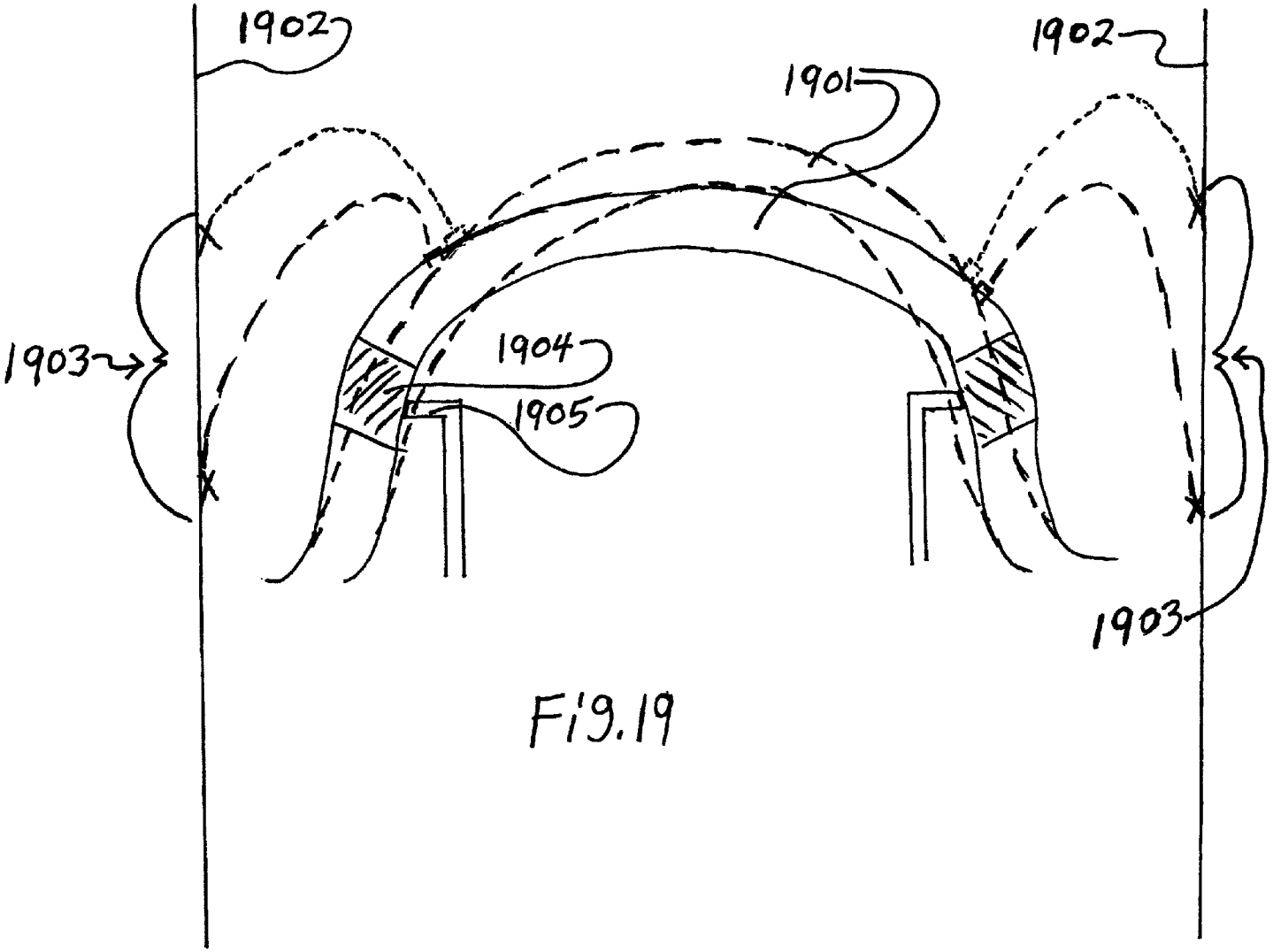

FIG. 19 is a side view of a motion-imparting time-lag representation of a sprinkler according to embodiments of the invention with its flexible tube oscillating toward a vertical position. The flexible tube is shown in contact with and traversing the curved longitudinal angle regulators. The progressive change in the longitudinal angle of the nozzles causes rectilinear impact locations of streams of water along the rectilinear lengthwise boundary of the rectangular area to be watered.

ALPHANUMERIC REFERENCES

X Waste water and/or run-off waste water
Y Corner area typically not watered by prior art sprinkler
101 Prior art sprinkler
102 Rectangular area to be watered
103 Elliptical water distribution pattern of prior art sprinkler
201 A sprinkler in accordance with embodiments of the invention
202 Rectangular area to be watered
203 Rectangular water distribution pattern of a sprinkler in accordance with embodiments of the invention
301 Unitary body with regulatory channels
302 Arcuate portion of unitary body located superior to the oscillating tube and comprising regulatory channels
303 Regulatory channels which regulate both the longitudinal and radial angles of the relatively long flexible nozzles, and through which the nozzles extend
304 Vertically-oriented portion of unitary body
305 Horizontally-oriented portion of unitary body
306 Portion of unitary body attachable to base structure of the oscillating sprinkler
301*a* Base structure
302*a* Flexible nozzle
303*a* Rigid, slick contact receptor
304*a* Curved longitudinal angle regulator
305*a* Curved radial angle regulator of a length that does not contact the end-most nozzles
306*a* Rigid oscillating tube
401 Base structure
402 Flexible nozzle
403 Rigid, slick contact receptor
404 Curved longitudinal angle regulator
405 Curved radial angle regulator with optional indentations for odd-numbered nozzles
406 Rigid oscillating tube
407 Optional indentations for odd-numbered nozzles
401*a* Stepped leading edge of an alternatively-shaped radial angle regulator
402*a* Horizontal length of step
501 Base structure
502 Flexible nozzle
503 Rigid, slick contact receptor
504 Curved longitudinal angle regulator
505 Curved radial angle regulator of length sufficient to contact the end-most nozzles
506 Rigid oscillating tube
601*a* Flexible nozzle
602*a* Rigid, slick contact receptor
603*a* Circumferential ridges between which is confined a rigid, slick contact receptor
601*b* Rigid oscillating tube with rectangular opening
602*b* Flexible tube with flexible nozzles
603*b* Flexible tube water-tight notched flange end
604*b* Flexible tube water-tight notched flange edge
605*b* Length of rigid oscillating tube (to accommodate "O" ring and oscillation mechanism with adjustable stops, not shown)
606*b* Water tight length of flexible tube fit inside of rigid oscillating tube
607*b* Flexible nozzle
701 Rigid oscillating tube with rectangular opening
702 Flexible nozzles on flexible rectangular base
703 Flexible base water-tight notched flange end
704 Flexible base water-tight notched flange edge
705 Length of rigid oscillating tube (to accommodate "O" ring and oscillation mechanism with adjustable stops, not shown)
801 Rigid oscillating tube with rectangular openings
802 Flexible nozzle on flexible rectangular base
803 Flexible base water-tight notched flange end
804 Flexible base water-tight notched flange edge
805 Length of rigid oscillating tube (to accommodate "O" ring and oscillation mechanism with adjustable stops, not shown)
901*a* Exemplary unitary grid formed of a single piece of material
902*a* Curved longitudinal angle regulator
903*a* Curved radial angle regulator
904*a* End-to-end interconnecting and reinforcing portion of grid
905*a* Portion of unitary grid attachable to base structure
901*b* Portion of unitary grid attachable to base structure
902*b* Base structure
903*b* Ridges on base structure
901*c* Portion of unitary grid attachable to base structure
902*c* Base structure
903*c* Slot in base structure
904*c* Tab on portion of unitary grid attachable to base structure
901*d* Portion of unitary grid attachable to base structure
902*d* Base structure
901*e* Portion of unitary grid attachable to base structure
902*e* Base structure
1001 Oscillating tube in a horizontal-most oscillating position
1002 Linear representation of five proximal flexible nozzles (the radial angles of which are being regulated by radial angle regulator, not shown)
1003 Rectilinear widthwise boundary and corners of rectangular area to be watered
1004 Rectilinear impact locations of streams of water
1101 Oscillating tube in a horizontal-most oscillating position
1102 Flexible nozzles (in contact with radial angle regulator, not shown)
1103 Flexible end-most nozzle optimally radially angled for maximal stream distance
1104 Even-numbered flexible nozzles optionally angled very slightly additionally "higher" to produce optional staggered impact locations on the ground

1105 Optional staggered impact locations of streams of water
1201 Rigid oscillating tube
1202 Flexible nozzle
1203 Lengthwise rectilinear boundary of rectangular area to be watered
1204 Rectilinear impact locations of streams of water along the rectilinear lengthwise boundary
1205 Rigid, slick contact receptor
1206 Curved longitudinal angle regulator
1301 Prior art oscillating sprinkler
1302 Rectangular area to be watered
1303 Prior art sprinkler's widely-spaced impact locations of streams of water
1304 Prior art sprinkler's narrowly-spaced impact locations of streams of water
1401 A sprinkler in accordance with embodiments of the invention
1402 Rectangular area to be watered
1403 Parallel evenly-spaced rectilinear impact locations of streams of water and rectangular water distribution pattern produced by a sprinkler in accordance with embodiments of the invention
1501 A sprinkler in accordance with embodiments of the invention
1502 Rectangular area to be watered
1503 Parallel evenly-spaced rectilinear impact locations of streams of water and rectangular water distribution pattern produced by a sprinkler in accordance with embodiments of the invention
1504 Optional staggered impact locations of streams of water of a sprinkler in accordance with embodiments of the invention in its horizontal-most oscillating position
1601 Base structure
1602 Bifurcated rigid oscillating tube
1603 Flexible tube
1604 Watertight length of flexible tube fit inside of bifurcated rigid oscillating tube
1605 Length of bifurcated rigid oscillating tube (to accommodate "O" ring and oscillation mechanism with adjustable stops, not shown)
1606 Rigid, slick contact receptor
1607 Curved longitudinal angle regulator
1608 Curved radial angle regulator
1609 Nozzles
1701 Base structure
1702 Bifurcated rigid oscillating tube
1703 Flexible tube
1704 Rigid, slick contact receptor
1705 Curved longitudinal angle regulator
1706 Curved radial angle regulator
1707 Nozzles
1801 Flexible tube (in contact with curved radial angle regulator, not shown)
1802 Rectilinear widthwise boundary of rectangular area to be watered
1803 Rectilinear impact locations of streams of water
1901 Flexible tube
1902 Lengthwise rectilinear boundary of rectangular area to be watered
1903 Rectilinear impact locations of streams of water along the rectilinear lengthwise boundary of the rectangular area to be watered
1904 Rigid, slick contact receptor
1905 Curved longitudinal angle regulator

TERMINOLOGY

Subjunctive words, for example "may be," "may distribute," and "may produce" are not meant to be construed as limiting, but rather are meant to be generally interchangeable with their corresponding indicative word forms such as "is," "distributes," and "produces" for example, and vice-versa.

DETAILED DESCRIPTION OF THE INVENTION

Generally, in the embodiments generally described in this disclosure:

All of the nozzles receive full flow of water at all times.

The impact locations on the ground of streams of water are parallel evenly-spaced and rectilinear throughout the length of the rectangular or square water distribution pattern.

The boundaries of the rectangular or square water distribution pattern are rectilinear and orthogonal both widthwise and lengthwise.

Water is provided to corner areas of typical rectangular or square areas to be watered without producing waste water and/or run-off waste water outside of the boundaries between the four corners.

The typical rectangular or square area to be watered is watered evenly throughout.

The parallel evenly-spaced rectilinear impact locations on the ground of streams of water, and the rectangular or square water distribution pattern are produced AUTOMATICALLY.

One method of using a sprinkler embodying the invention is to place the sprinkler in the center of the area to be watered and then to adjust the flow from the faucet so the size of the water distribution pattern is compatible with the size of the area to be watered. Alternatively, the sprinkler may be placed at an edge of the area in which case the adjustable stops on the oscillation mechanism may be engaged causing the oscillating tube to oscillate between the vertical and only one horizontal-most position. Efficiency is available to the user by appropriately locating the sprinkler within the area to be watered, directionally orienting the sprinkler, engaging or disengaging adjustable stops on the oscillation mechanism, and adjusting the flow from the faucet. Thereby a full-sized rectangular distribution pattern as large as the sprinkler is capable of producing, or a less than full-sized rectangular pattern of the right, left, or center section of a full sized pattern may be produced—all of which are rectangular shaped. If the oscillation mechanism is disconnected or otherwise adjusted causing the tube to remain in a fixed position, embodiments of the current invention may also be used to evenly water a linear area such as a row of flowers or a row of bushes or trees for example, with no oscillation involved.

Figure 1B:
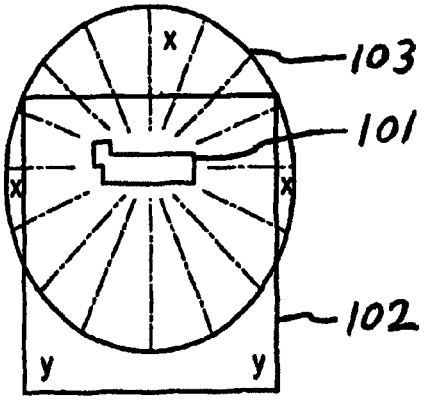
PRIOR ART FIG.1b
Figure 2B:
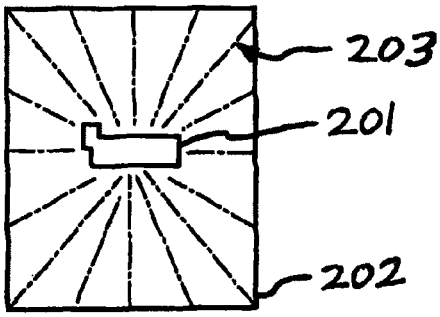
Figure 1C:
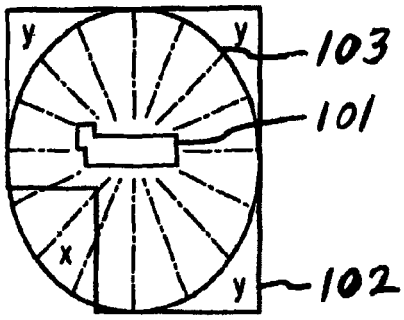
PRIOR ART FIG.1c
Figure 2C:
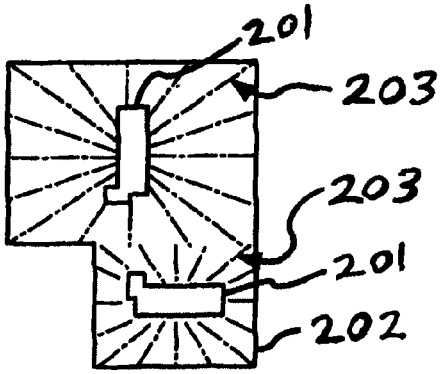

FIGS. 1*a*, 1*b*, and 1*c* show examples that if a prior art sprinkler 101 is located where its elliptical water distribution pattern 103 does not distribute water beyond the boundaries of a typical rectangular area to be watered 102, corner areas Y may not receive water. If the prior art sprinkler is located where the water does reach the corner areas, then waste water and/or run-off waste water X results between the corners. FIGS. 2*a*, 2*b*, and 2*c* show that the problem of corner areas not receiving water, and the problem of waste water and/or run-off waste water between corners are solved by the rectangular water distribution pattern 203 which is geometrically compatible with the typical rectangular area to be watered 202 and which is automatically produced by sprinkler 201, in accordance with embodiments of the invention.

FIG. 3 shows an exemplary unitary body 301 comprising regulatory channels 303 which regulate both the longitudinal and radial angles of relatively long, flexible nozzles as the oscillating tube oscillates. The relatively long, flexible nozzles extend from the oscillating tube through the channels. The unitary body may be attached to the base structure of the sprinkler by an attachable portion 306. The unitary body may include vertically-oriented portions 304, horizontally-oriented portions 305, and an arcuate portion 302 which is located superior to the oscillating tube and which comprises the regulatory channels 303.

The device of FIG. 3 represents a way of enabling an oscillating sprinkler to 1) automatically produce a rectangular water distribution pattern 2) automatically produce even watering with parallel evenly-spaced rectilinear impact locations of water on the ground throughout the length of the water distribution pattern, and 3) automatically water the corners without producing waste water between the corners. The results may be seen in FIG. 14 and FIG. 15. The device of FIG. 3 functions basically in the same way and produces the same results as are described herein regarding FIGS. 3*a* through 15. One difference between the unitary body of FIG. 3 and the devices of FIGS. 3*a* through 12 is that regarding 3*a* through 12 the flexible nozzles must be manufactured in relatively precise longitudinal (and radial) angles and be somewhat resilient so as to exert some force against the curved longitudinal angle regulators. Regarding FIG. 3, the longitudinally-outwardly angled nozzles used may be made of less substantial material and may be simply shaped cylindrically throughout their length. The size, shape, and location of the regulatory channels will regulate the longitudinal and the radial angles of the nozzles as desired.

The relatively long flexible nozzles that may be used in regard to FIG. 3 may comprise circumferential ridges as in 603*a* between which may be confined a rigid, slick contact receptor as in 602*a*. The rigid, slick contact receptor is in loose, low-friction contact with the walls of the regulatory channels. The walls of each regulatory channel may be beveled or angled so as to be parallel with the rigid, slick contact receptor of the nozzle that extends through the channel. The bevel or angle of the walls of each channel may vary through the "circumferential" or lateral length of the channel in order to be parallel with the rigid, slick contact receptor throughout a complete oscillation cycle. As the sprinkler operates, water that falls onto the channel walls and rigid, slick contact receptors may function as a lubricant to reduce friction.

Considering the relatively long flexible nozzles independent of the regulatory channels, and considering them prior to being inserted through the channels, the longitudinally outward angle of each nozzle increases as the nozzles distance from the center nozzle increases. This is as is typical of prior art and sprinklers embodying the invention.

Regarding the regulatory channels 303, the longitudinal length or distance from one termination of the channel to the center point of the channel increases as the channel's distance from the center channel increases. Thereby, the amount of change in the longitudinal angle of a nozzle from the horizontal-most to the vertical oscillating position is greatest for the end-most nozzles and least for the center nozzle. This is what is required to change the curved and unevenly-spaced lines of a prior art sprinkler of FIG. 13 in general, and in regard to 1303 and 1304 in particular, to the rectilinear and evenly-spaced lines shown in FIG. 14. For example, if one considers the regulation of an end-most nozzle, one will notice that in the horizontal-most oscillating position, the longitudinal angle of the nozzle is unchanged from what it would be if there were no channels and no regulation at all, but in the vertical position, the amount of change effected by the channel is greatest and the rectilinear lengthwise boundaries and rectilinear impact locations of water on the ground are formed. The parallel even spacing of the rectilinear lines of FIG. 14 are formed because the amount of change in the longitudinal angle of a nozzle increases as the nozzle's distance from the center nozzle increases.

Stated differently, the size, shape, and location of the regulatory channels regulates the longitudinal angle of the nozzles as the oscillating tube oscillates such that the impact locations of the water on the ground are changed from those as seen in FIG. 13, to those as seen in FIG. 14. The longitudinal angle of each nozzle is regulated at any given point of the oscillation cycle, to the extent needed to produce the rectilinear lengthwise boundaries of the water distribution pattern, and the evenly-spaced rectilinear impact locations throughout the length of the rectangular water distribution pattern. The amount of change in the longitudinal angle of a nozzle from the horizontal-most to the vertical oscillating position may increase as the nozzle's distance from the center nozzle increases. The center nozzle undergoes no longitudinal angle regulation at all.

Regarding the regulatory channels 303, the "circumferential", or lateral length or distance from one termination of the channel to the center point of the channel increases as the channel's distance from the center channel increases. Thereby the change in the radial angle of a nozzle at and/or near a horizontal-most oscillating position is greatest for the center nozzle and least for the end-most nozzles. The end-most nozzles undergo no radial angle regulation at all. This is what forms the rectilinear widthwise boundaries of the rectangular water distribution pattern.

The "circumferential", or lateral length of the channels on the arcuate portion of the device of FIG. 3 regulates the radial angle of the nozzles at and/or near the horizontal-most oscillating position, thereby forming the rectilinear widthwise boundaries of the rectangular water distribution pattern. The "circumferential", or lateral length of each channel increases as the channel's distance from the center channel increases. As the oscillating tube approaches a horizontal-most oscillating position, the rigid, slick contact receptor of a nozzle comes in contact with the distal or proximal termination of a channel, and the motion of that nozzle is stopped. In this position, the end-most nozzles are at a radial angle optimal for producing an impact location of water on the ground a maximal horizontal distance from the sprinkler, thereby forming the corners of the rectangular water distribution pattern. Each nozzle, other than the end-most nozzles, are "stopped" at a redial angle "higher" than optimal and thereby produce an impact location of water on the ground less than a maximal horizontal distance from the sprinkler. In this horizontal-most oscillating position, the number of degrees "higher" than optimal of the radial angle of each nozzle increases as the nozzle's distance from the end-most nozzle increases. As an example, in this oscillating position, the end-most nozzles may be radially angled at approximately 45 degrees while the center nozzle may be radially angled at approximately 55 degrees. Thereby, the corners and the rectilinear widthwise boundaries of the rectangular water distribution pattern are produced. This may be seen in FIG. 10 for example.

One will notice that the regulatory channels do not decrease the horizontal distance from the sprinkler to the corners of the rectangular water distribution pattern. This is because in the horizontal-most position, the end-most nozzles do not undergo any longitudinal nor any radial angle regulation at all, and water is provided to the corners as far from the sprinkler as the sprinkler's maximal capacity allows. One will notice that in a horizontal-most position, all of the regulation takes place with all of the nozzles except the end-most nozzles. One will also notice that in all positions of the oscillation cycle except the horizontal-most, all of the regulation takes place with all of the nozzles except the center nozzle.

FIG. 3 may visually lead one to believe that the number of degrees of alteration or regulation, and/or the linear measure of alteration or regulation, in the longitudinal and the radial angles of the flexible nozzles throughout a complete oscillation cycle may be relatively great. In fact, the amount of alteration or regulation is quite small and easily accomplished.

It is anticipated that for example, there may be approximately ¼ of an inch of space between the oscillating tube and the arcuate portion 302 comprising the regulatory channels 303, and anticipated that the flexible nozzles may extend approximately ¼ inch above the regulatory channels, though many possibilities exist in this regard.

If desired by the manufacturer, optional staggered rectilinear impact locations of water on the ground at the widthwise boundaries may be produced by slightly reducing the circumferential side-to side length of even numbered channels. This option is discussed elsewhere in this disclosure and may be seen in 1105 of FIG. 11 and 1504 of FIG. 15.

If desired by the manufacturer, the arcuate portion 302 comprising the channels, and/or the rigid, slick contact receptors such as in 602*a* may be made available to the consumer as consumer-replaceable "snap-on" replacement parts.

A typical prior art sprinkler may provide less water per square foot when the oscillating tube is at and/or near the vertical position. This is because at and/or near vertical, the elliptical water distribution pattern is maximally wide, and the impact locations on the ground of all of the streams of water are maximally widely-spaced. The impact locations on the ground conversely, are minimally widely-spaced and closest together in the horizontal-most positions wherein the elliptical water distribution pattern is narrowest. This is depicted in FIG. 13 in general, and in 1303 and 1304 in particular. This may cause a prior art sprinkler to unevenly distribute water within its ellipse with maximal amounts of water per square foot at each end and minimal water per square foot across the center of the ellipse wherein the oscillating tube is at and near the vertical position. Conversely a sprinkler in accordance with embodiments of the invention longitudinally regulates the angle of not only the end-most nozzles that form the rectilinear lengthwise boundaries, but of all of the nozzles except the center nozzle. The degrees of change of the longitudinally outward angle of all of the nozzles, during an oscillation cycle, increases as the nozzle's distance from the center nozzle increases. Thereby, the impact locations on the ground of streams of water from all of the nozzles are evenly-spaced, and rectilinear throughout the entire oscillation cycle. They do not form curved paths within the boundaries, but form rectilinear paths lengthwise from one widthwise boundary to the second widthwise boundary. Thereby embodiments of the current invention may automatically, very evenly water a typical rectangular area to be watered.

Regarding FIG. 3*a*, base structure 301*a* may function as a stable base for the entire sprinkler and also as a component to which the curved longitudinal angle regulators 304*a* and curved radial angle regulators 305*a* may be attached. The angle regulators may be attached by various means such as being of one mold with the base structure, with screws, with tabs and slots, and/or by "snap on" friction in combination with tabs and slots etc. Tabs and slots, grooves and flanges, etc., may be used to cause the angle regulators to be positioned precisely in place. Precise positioning, size, and shape of the angle regulators is essential for automatically producing the evenly-spaced rectilinear impact locations of water on the ground, and the rectilinear widthwise and also lengthwise boundaries of the rectangular water distribution pattern. For clarity and simplicity the drawings except for FIG. 9*a* show the angle regulators as individual components. However, it is likely they may be interconnected by additional parts that may extend throughout, interconnecting the regulators into a unitary grid as exemplified in FIG. 9*a*. By this method, for example, all of the longitudinal angle regulators may be interconnected as a unitary grid and it is likely that the radial angle regulators may also be connected to the grid, thereby all of the angle regulators may constitute a single unitary grid, made of a single piece of material. Many configurations of the unitary grid may be contemplated and coordinated with, for example, the length of the flexible nozzles, and the distance from one base structure member to the other etc. The general side-to side shape of the unitary grid may be "domed" or "squared," for example. Rigid oscillating tube 306*a* has sufficient length (not shown) between the water motor and the first proximal end-most nozzle to accommodate an "O" ring and an oscillation mechanism with adjustable stops (not shown). Flexible nozzles 302*a* are relatively long. It must be understood that even though they are flexible, they are of a material and of a size and shape (see FIGS. 6*a*, 6*b*, 7, and 8) that causes each nozzle, when not in contact with an angle regulator, to be precise in its longitudinal and radial angle. Thereby, all of the nozzles, when not in contact with an angle regulator have the same radial angle just as they would if they were rigid instead of flexible. Also thereby, the longitudinally outward angle of each nozzle increases as the nozzle's distance from the center nozzle increases, just as they would if they were rigid instead of flexible. Each flexible nozzle may have a rigid, slick contact receptor 303*a* which comes into contact with the angle regulators. FIG. 3*a* shows the nozzles in the vertical oscillating position. At this vertical point of the oscillation cycle, the number of degrees of decrease in the longitudinally outward angle that each nozzle is being flexed increases as the nozzle's distance from the center nozzle increases. Within the oscillation cycle, as the oscillating tube rotates from a horizontal-most position toward the vertical position, the rigid, slick contact receptor of each nozzle contacts and traverses the curved part of its corresponding longitudinal angle regulator. The size, shape, and location of the curved part of each longitudinal angle regulator progressively reduces the longitudinally outward angle of the end most nozzles as the oscillating tube rotates from a horizontal-most position toward the vertical position, to the extent that impact locations of streams of water from the end-most nozzles do not form a curve producing the lengthwise portion of an ellipse and producing waste water and/or run-off waste water X, as does a prior art sprinkler. Instead, the impact locations form the rectilinear lengthwise boundaries of the rectangular water distribution pattern. As the cycle continues and the tube rotates from the vertical toward the second horizontal-most position, the effect is basically reversed in that the longitudinally outward angle of the end-most flexible nozzles is progressively increased as the rigid, slick contact receptor of the nozzles traverses the second half of the curved part of the longitudinal angle regulator and as the flexible nozzle is progressively allowed to return to its unregulated longitudinally outward angle. Thereby, the impact locations of streams of water from the end-most flexible nozzles form the second half of the rectilinear lengthwise boundaries of the rectangular water distribution pattern.

FIG. 4 is a top view, therefore it is easy to see the curved portions of the longitudinal and radial angle regulators. The regulation of the longitudinal and radial angles of the flexible nozzles may automatically produce parallel evenly-spaced rectilinear impact locations of water and a rectangular water distribution pattern with substantially equal amounts of water delivered to every square foot of a typical rectangular area to be watered.

Continuing with FIG. 4, radial angle regulator 405 may, in variations, optionally comprise indentations 407 for the purpose of receiving the odd-numbered flexible nozzles as the oscillating tube reaches a horizontal-most position. Thereby, in this option or variation, as per FIG. 11, the end most nozzles are optimally radially angled to produce streams of maximal horizontal distance from the sprinkler thereby demarcating the corners of the rectangular water distribution pattern and defining the overall size of the rectangular water distribution pattern. The radial angle of the flexible nozzles is regulated by the radial angle regulator when the nozzles are in a horizontal-most position. The number of degrees "higher than" optimal of each nozzle increases as the nozzle's distance from the end-most nozzles increases. Thereby the rectilinear widthwise boundaries of the rectangular water distribution pattern are produced. The point to be made in viewing the radial angle regulator 405 which comprises the optional indentations 407, and in viewing FIG. 11, is that rectilinear but staggered impact locations may be produced. Odd numbered nozzles in this variation, are allowed to proceed very slightly closer to the optimal radial angle while the even numbered nozzles without the indentations, are "stopped" very slightly "additionally" "higher" than if they were to proceed into an indentation. Thereby the rectilinear but staggered impact locations may be produced if the manufacturer so desires. This option or variation may be applicable if the manufacturer desires to counter the possibility that additional water per square foot may be distributed to the widthwise boundaries, not because of unevenness of distribution by the nozzles, but because the sprinkler embodying the invention, just like prior art sprinklers, may temporally pause in each horizontal-most position as the oscillating tube comes to a stop and reverses its direction of rotation. Staggered impact locations along each widthwise boundary is therefore an option available with embodiments of the current invention.

As an option to having indentations for only odd-numbered nozzles, a curved radial angle regulator may have an indentation for all of the nozzles it will come into contact with. This may be desirous because a nozzle received and contacted within an indentation will not be able to undesirably slide out of position longitudinally while it is being pressed against the curved radial angle regulator. The option of producing staggered rectilinear impact locations as described above, and also the option of having an indentation for all of the nozzles that will come in contact with a radial angle regulator may both be desired by the manufacturer. If such is the case, the indentations for odd-numbered nozzles may be slightly "deeper" indentations than those for even-numbered nozzles—thereby the rectilinear staggered impact locations may be produced.

As the flexible nozzles approach a horizontal-most oscillating position, the rigid, slick contact receptor of the center nozzle may contact a curved radial angle regulator near, for example, a radial angle of approximately 55 degrees. The radial angle at which each rigid, slick contact receptor may contact the curved radial angle regulator decreases as its distance from the center nozzle increases, the end most nozzles most likely reaching an exemplary optimal radial angle of approximately 45 degrees. Thereby, the rectilinear widthwise boundaries are produced. It may be desirous that the leading edge surface of a curved radial angle regulator that is contacted by the rigid, slick contact receptors, be oriented at a similar angle, of for example an angle of approximately 50 degrees. It may be difficult to visually perceive in the drawings but it may be desirous that the curved portion of radial angle regulators extend, not horizontally, but extend at an angle approximately matching that of the nozzles as they approach and contact it. It may be desirous that (1) the curved portion or (2) the leading edge surface of the curved portion be oriented at an angle matching, or approximately matching that of the nozzles. A variety of functional configurations may be contemplated. For example, the curved portion of a radial angle regulator may extend at approximately a 50 degree angle, or it may extend generally horizontally with only the leading edge surface oriented at an approximate 50 degree angle.

FIG. 4*a* shows that as an option to a radial angle regulator having a curved leading edge with or without indentations, the leading edge may instead be a stepped leading edge 401*a*. A stepped version may perform the same function as the curved version with indentations, or the curved version without indentations. Each step may receive and contact a nozzle. Being generally rectilinear, the surface of the step that is contacted by a rigid, slick contact receptor may prevent the nozzles from undesirably sliding out of position longitudinally. Also, if the option of producing rectilinear staggered impact locations is desired, a slight increase in the horizontal length of steps 402*a* for the even-numbered nozzles, or else a slight decrease in the horizontal length of steps 402*a* for the odd-numbered nozzles, will produce the rectilinear staggered impact locations.

FIG. 5 shows an option or variation wherein the radial angle regulator is of a length sufficient to contact and regulate all of the flexible nozzles including the end-most nozzles. In FIGS. 3 and 4 for example, no contact is made between the radial angle regulators and the end-most nozzles in as much as the end-most nozzles's radial angles are not regulated but are allowed to reach a radial angle optimal for producing impact locations of streams of water a maximal distance from the sprinkler, thereby demarcating the corners of, and defining the overall size of the rectangular water distribution pattern. In some embodiments, the two radial angle regulators may be of a sufficient length as to contact all of the flexible nozzles, including the end-most nozzles, then the manufacturer may potentially simplify the production of a sprinkler embodying the invention and potentially reduce the financial cost of production. This may be because it may be complicated and/or financially expensive to manufacture a sprinkler with the water motor and gears, etc., calibrated and configured to rotate the oscillating tube relatively precisely to a desired horizontal-most angle, a 45 degree angle for example. Conversely, it may be very simple and very financially inexpensive to simply have radial angle regulators which position all of the flexible nozzles, including the end-most nozzles, in radial angles so as to produce the rectilinear widthwise boundaries of the rectangular water distribution pattern even if the sprinkler is simply and inexpensively calibrated and configured, with a margin of error, to rotate with a relatively low level of precision, "farther than" or "beyond" the radial angle which is optimal for producing streams of water with impact locations of a maximal distance from the sprinkler, 45 degrees for example. This concept of novelty is that the manufacturer may benefit from a margin of error regarding the angle at which the direction of rotation is reversed. In this case the manufacturer may simply and inexpensively configure the sprinkler to rotate to an angle within a range between, for example 45 and 30 degrees, knowing that the inexpensive, simple, radial angle regulators will angle the flexible nozzles precisely to produce the rectilinear widthwise boundaries of the rectangular water distribution pattern. Alternatively, the manufacturer may choose to use a radial angle regulator that is of a shorter length so as to contact all of the nozzles except the end-most nozzles, as may be seen in FIGS. 3*a* and 4, for example.

Embodiments of the current invention may use flexible nozzles 601*a* with rigid, slick contact receptor 602*a* held in place by circumferential ridges 603*a* on the flexible nozzle. Even though they are flexible, the nozzles are oriented at a definite radial and definite longitudinal angle when they are manufactured and when they are not in contact with any angle regulator. A portion of the nozzle between the rigid, slick contact receptor and the larger base portion of the nozzle flexes when the nozzle is in contact with an angle regulator thereby regulating the direction of the stream of water emanating from the nozzle. The flexible nozzles in most of the drawings are depicted as having a relatively large base area, usually a generally conical, square, or rectangular base area, however this is meant to be exemplary. Any functional shape of a flexible nozzle may be used. The nozzles need to have a definite radial and longitudinal angle when not in contact with an angle regulator, to be flexible, to accommodate and retain some type of contact receptor, etc. Nozzles of the shape shown in FIG. 11 (rigid, slick contact receptors not shown in FIG. 11) for example, may function as desired.

The drawings and/or text of this disclosure may mislead the reader into perceiving that the number of degrees of change in the angles of the nozzles and the corresponding amount of flexion effected by the angle regulators are larger than may in fact be the case. In fact, experiments indicate that the greatest alteration in the number the degrees of a nozzle may be, as an example, approximately 10 degrees. The flexible nozzles may be relatively longer than most nozzles on prior art sprinklers.

One method of incorporating flexible nozzles into embodiments of the current invention is to produce a rigid oscillating tube with a rectangular opening 601*b* and insert into it a flexible tube comprising flexible nozzles 602*b*. The flexible tube, flexible notched flanges, and flexible nozzles may be "all of one mold," and made of a single piece of material. Flexible tube notched flange end 603*b* and flexible tube notched flange edge 604*b* are geometrically configured to fit into the rectangular opening of the rigid tube and form a water-tight seal. (See FIGS. 7 and 8). Proximal to the rectangular opening is a length of the rigid oscillating tube 605*b* (for accommodating an "O" ring and oscillation mechanism with adjustable stops, not shown). Length 606*b* is water-tight. Flexible nozzles 607*b* have a definite longitudinal and radial angle orientation when manufactured. Their flexibility allows for angle regulators to alter their angles and therefore also the direction and the horizontal distance from the sprinkler that a stream of water travels before impacting the ground. Thereby, evenly-spaced rectilinear impact locations of water, and a rectilinear and rectangular water distribution pattern may be automatically produced.

Another method of incorporating flexible nozzles into embodiments of the current invention is to produce a rigid oscillating tube with a rectangular opening 701, and insert into the rectangular opening flexible nozzles on a flexible rectangular base 702, with notched flange end 703, and notched flange edge 704 which form a water-tight seal. Proximal to the rectangular opening in the rigid oscillating tube is a length of the rigid oscillation tube 705 (for accommodating "O" ring and oscillation mechanism with adjustable stops, not shown).

Another method of incorporating flexible nozzles into embodiments of the current invention is to produce a rigid oscillating tube with rectangular openings 801, and insert into the rectangular openings a flexible nozzle on a rectangular base 802, with notched flange end 803, and notched flange edge 804 which form a water-tight seal. Proximal to the rectangular openings in the rigid oscillating tube is a length of the rigid oscillating tube 805 (for accommodating "O" ring and oscillation mechanism with adjustable stops, not shown).

Other methods of incorporating flexible nozzles onto a rigid tube are contemplated.

An exemplary unitary grid 901*a* may be constructed of a single piece of material. The unitary grid comprises longitudinal angle regulators 902*a*, radial angle regulators 903*a*, end-to-end interconnecting and reinforcing portions 904*a*, and a portion of the unitary grid 905*a* that is attachable to the base structure of a sprinkler embodying the current invention.

FIGS. 9*b* through 9*e* exemplify various means by which an attachable portion of a unitary grid may be attached and precisely positioned on to a base structure of a sprinkler embodying the invention. Many methods of attaching and precisely positioning a unitary grid to a base structure may be contemplated by one skilled in the art. Attachment and precise positioning may be accomplished most simply and economically by configuring the attachable portion of the unitary grid to frictionally "snap on" to the base structure such that it not only is securely attached, but is also precisely positioned. Many such configurations are contemplated such that the securing and positioning holds the unitary grid securely "side to side, end to end, and up and down" onto the base structure. FIG. 9*b* shows a side view of an attachable portion of the unitary grid 901*b* "snapped on" to the base structure 902*b* and precisely positioned "end-to-end" by ridges 903*b* on the base structure. Similar in function, FIG. 9*c* shows an end view of attachable portion of unitary grid 901*c* with tab 904*c* extending through slot 903*c* in base structure 902*c*. FIGS. 9*d* and 9*e* show end views of attachable portions of unitary grid frictionally "snapped on" to base structure. Any such configuration of attachment simply needs to effect secure attachment and stable, precise positioning of the unitary grid on to the base structure. If so desired by the manufacturer, other methods and/or other components or devices such as screws, may be used.

FIG. 10 is an end view showing the production of rectilinear impact locations of streams of water 1004 along the rectilinear widthwise boundary 1003 when the oscillating tube 1001 is in a horizontal-most oscillating position. This drawing is a end view using simple lines to represent the radial angle of the proximal five nozzles 1002. The end most nozzle is at a radial angle such as 45 degrees for example, optimal for producing a stream of water with an impact location in the corner, a maximal distance from the sprinkler. A radial angle regulator, (not shown), is in contact with the nozzles. The number of degrees "higher" than optimal of the radial angle of each nozzle increases as the nozzle's distance from the end-most nozzles increases. Thereby, the corners and a rectilinear widthwise boundary are automatically produced.

The information conveyed in FIG. 11 is similar to that of FIG. 10. FIG. 11 is a perspective view that demonstrates an option or variation easily available to the manufacturer should the manufacturer choose to use it. The oscillating tube 1101 is in a horizontal-most position. End-most nozzles 1103 are at a radial angle optimal for producing streams of water with impact locations in the corners a maximal horizontal distance from the sprinkler. The radial angle regulator (not shown) is in contact with the flexible nozzles 1102. As in FIG. 10, the number of degrees "higher" than optimal of the radial angle of each nozzle increases as the nozzle's distance from the end-most nozzles increases. However, with this option, the radial angle of the even-numbered nozzles may be very slightly additionally "higher," thereby a second rectilinear row of impact locations is produced a desired distance inward from the boundary. The optional staggered impact locations along the rectilinear widthwise boundaries may be produced by various means which are shown in FIGS. 4 and 4*a* and discussed in the text regarding FIGS. 4 and 4*a* (See also FIG. 15). If the oscillating tube of an inexpensively manufactured sprinkler pauses for a short period of time in the horizontal-most positions as it reverses its direction, it may provide more water to the end or widthwise boundaries than to other parts of the area to be watered. The optional staggered impact locations 1105 may be used to spread out the impact locations of water produced during the time that the movement of the oscillating tube is paused, thereby more evenly distributing the water, if so desired by the manufacturer.

FIG. 12 is a side view of a motion-imparting time-lag representation of the production of the rectilinear lengthwise boundaries of the rectangular water distribution pattern. For clarity and simplicity, only the end-most nozzles are shown. As was described in conjunction with FIG. 3*a*, as the oscillating tube 1201 rotates from one horizontal-most position toward the vertical, the rigid, slick contact receptor 1205 of the flexible end-most nozzle 1202 contacts and traverses the curved longitudinal angle regulator 1206. The longitudinally outward angle of the end-most nozzle is progressively decreased from horizontal-most to vertical, then allowed to progressively increase from vertical to the second horizontal-most position. Thereby the rectilinear impact locations of water 1204 produce the rectilinear lengthwise boundaries 1203 of the rectangular water distribution pattern. As shown in other drawings, all of the nozzles except the center nozzle, are altered longitudinally throughout the oscillation cycle, thereby the evenly-spaced, rectilinear impact locations of water are produced throughout the length of the rectangular water distribution pattern. The number of degrees of change in the longitudinally outward angle of each nozzle increases as the nozzle's distance from the center nozzle increases. (See also FIG. 14 and the text regarding FIG. 14).

FIG. 13 shows problems and inefficiencies of typical prior art sprinkler 1301. It shows the curved impact locations of streams of water and the elliptical water distribution pattern of typical prior art sprinkler 1301 superimposed over a rectangular area to be watered 1302. It shows curved impact locations outside of the widthwise and lengthwise boundaries which represent waste water and/or run-off waste water. It also shows unevenness in the amount of water delivered to a given square foot of area regardless of the shape of the area to be watered. This unevenness is shown by the narrowly-spaced impact locations 1304 at and/or near the "ends" as compared to the widely-spaced impact locations 1303 at and/or near the center section of the area being watered. Stated differently, FIG. 13 shows waste water between the corners, and also the unevenness in the amount of water distributed per square foot while the prior art sprinkler is in a horizontal-most position 1304 compared to the amount per square foot in the vertical position 1303.

A typical prior art sprinkler may deliver substantially more water per square foot to the "ends" than to the center because it: (1) produces impact locations narrowly-spaced at the "ends" and widely-spaced at the center, and also (2) typically spends more time, or more seconds per minute in a horizontal-most position, as its oscillating tube slows down and pauses or "stops" in the process of changing directions of rotation, than it spends passing through the vertical position.

Conversely, a sprinkler in accordance with embodiments of the invention produces parallel evenly-spaced rectilinear impact locations by automatically regulating the longitudinal angle of all of the nozzles except the center nozzle (See FIG. 14). However, similar to a prior art sprinkler, an inexpensively manufactured sprinkler embodying the invention also may be in a horizontal-most position for more time or for more seconds per minute than at its vertical position, that is why embodiments of the current invention offer the manufacturer the option of spreading out water impact locations along the rectilinear widthwise boundaries by staggering the impact locations along the widthwise boundaries as is discussed elsewhere in this disclosure (See FIGS. 11 and 15).

FIG. 14 shows exemplary sprinkler 1401, by way of its longitudinal angle regulators, automatically producing parallel evenly-spaced rectilinear impact locations of streams of water 1403 throughout the entire oscillation cycle, throughout the entire rectangular water distribution pattern, and along the rectilinear lengthwise boundaries. It shows, by way of its radial angle regulators, the automatic production of evenly-spaced and rectilinear impact locations along the rectilinear widthwise boundaries. It shows the even distribution of water per square foot within the entire rectangular area to be watered 1402.

FIG. 15 shows generally the same information as FIG. 14 except that FIG. 15 includes showing the option of producing two rectilinear rows of impact locations or "staggered" impact locations of water along the widthwise boundaries. This option is discussed elsewhere in this disclosure and is available to the manufacturer if the manufacturer wishes to partially counter the effects of an oscillating tube spending more time or more seconds per minute at and/or near a horizontal-most position while the oscillating tube slows down and "stops" as it reverses its direction of rotation, than it spends in other oscillating positions.

FIGS. 16 through 19 generally refer to another embodiment of the current invention.

FIG. 16 is a side view showing an embodiment of the current invention in the vertical oscillating position and with base structure 1601 and bifurcated rigid oscillating tube 1602. The bifurcated rigid oscillating tube has a length 1605 (for accommodating "O" ring and oscillation mechanism with adjustable stops, not shown). The ends of the flexible tube 1603, are disposed into the ends of the bifurcated rigid oscillating tube with water tight length 1604. The flexible tube is not a length of tube cut from a roll of tubing, but is a tube manufactured individually and has a definite shape, length, and angular orientation of its nozzles, etc. Widthwise and lengthwise channels, grooves, ridges, etc., (not shown) on the outside of the flexible tube ends and on the inside wall of the bifurcated length of the rigid oscillating tube within the length 1604 may be used to precisely position the flexible tube and precisely determine its overall length and ensure that its shape is not distorted by twisting, etc. The flexible tube has rigid, slick contact receptors 1606 and nozzles 1609. The nozzles 1609 may be "of the same mold" as the tube, the tube and nozzles being made of a single piece of material. Alternatively, the nozzles may be separate components. Alternatively, the nozzles may simply be cylindrically round openings extending throughout the wall thickness of the flexible tube if the length of the wall thickness is sufficient to constitute a cylindrically round "nozzle." In a horizontal-most oscillating position, the median part of the flexible tube contacts curved radial angle regulator 1608. The center of the flexible tube is thereby stopped from proceeding while the ends of the tube continue to their full horizontal-most position. Thereby, in the horizontal-most position, the number of degrees "higher" than optimal of the radial angle of each nozzle increases as the nozzle's distance from the end-most nozzles increases. The end-most nozzles stop their rotation at a radial angle, 45 degrees for example, optimal for producing impact locations of maximal distance from the sprinkler, and forming the corners of the rectangular water distribution pattern. Thereby the rectilinear impact locations are produced along the rectilinear widthwise boundary. Note that the length of the radial angle regulator 1608 is small relative to the overall length of the flexible tube. FIG. 16 shows the rigid, slick contact receptors in contact with the longitudinal angle regulators and shows the rigid oscillating tube in its vertical position, and shows the flexible tube less curved and more linear than when the flexible tube is not in contact with the longitudinal angle regulators. This "relatively less curved and more linear" shape of the flexible tube reduces the longitudinal outward angle of the nozzles and produces the rectilinear lengthwise boundaries of the rectangular water distribution pattern. It also may produce evenly-spaced rectilinear impact locations throughout the water distribution pattern such as shown if FIG. 14. As the oscillating tube rotates from a horizontal-most position to the vertical position, and from the vertical to a horizontal-most position, the rigid, slick contact receptor 1606 contacts and traverses the curved longitudinal angle regulator 1607. From horizontal-most to vertical, the curve of the longitudinal angle regulator changes the shape of the flexible tube to be "relatively less curved and more linear" thereby progressively reducing the longitudinally outward angle of all of the nozzles except the center nozzle. From vertical to horizontal-most, the curve of the longitudinal angle regulator allows the resilience of the flexible tube to progressively return to its "relatively less linear and more curved" shape. This produces rectilinear impact locations along the lengthwise boundary of the rectangular water distribution pattern and may produce evenly-spaced rectilinear impact locations of streams of water on the ground throughout the rectangular water distribution pattern as shown in FIG. 14. In this embodiment, the two longitudinal angle regulators and the two radial angle regulators may be reinforced, strengthened, and held precisely in position by interconnecting parts, (not shown) and may attach to the base structure 1601. Note that with this embodiment, the length of the curved radial angle regulator is relatively short in as much as its function is to contact the flexible nozzle at and near the location of the center nozzle. Note that with this embodiment, a stepped radial angle regulator would not be used. With this embodiment, the option of staggered impact locations of streams of water along the rectilinear widthwise boundaries may be accomplished by manufacturing the flexible tube with its row of nozzles having slightly staggered radial angles.

FIG. 17 shows a top view of an embodiment with a rigid bifurcated oscillating tube 1702, flexible tube 1703, curved longitudinal angle regulators 1705, and curved radial angle regulators 1706. The rigid oscillating tube is shown in a horizontal-most position and the section of the flexible tube at and near its center nozzle is shown in contact with a radial angle regulator. The section of the flexible tube near the center nozzle may have a rigid contact receptor (not shown) for coming into contact with the curved radial angle regulator. The flexible tube in FIG. 17 is seen in its curved shape and length as it was manufactured. It is seen "relatively more curved and less linear" than in FIG. 16 where it is in contact with the curved longitudinal angle regulators. In this horizontal-most position, the end-most nozzles are at a radial angle optimal for producing streams of water that travel a maximal horizontal distance from the sprinkler and define and demarcate the corners of the rectangular water distribution pattern. When in contact with a radial angle regulator, the number of degrees "higher" than optimal of the radial angle of each nozzle increases as the nozzle's distance from the end-most nozzles increases, thereby the rectilinear impact locations along the rectilinear widthwise boundaries are produced. Longitudinal and radial angle regulators may be strengthened, reinforced, and held precisely in position by interconnecting parts (not shown).

FIG. 18 shows the flexible tube 1801 in a horizontal-most position in contact with the curved radial angle regulator (not shown). The end-most nozzles are at a radial angle optimal for producing impact locations a maximal horizontal distance from the sprinkler and defining and demarcating the corners of the rectangular water distribution pattern. The number of degrees of radial angle "higher" than optimal of each nozzle increases as the nozzle's distance from the end-most nozzles increases. Thereby the rectilinear impact locations of streams of water 1803 produce the rectilinear widthwise boundaries of the rectangular area to be watered 1802.

FIG. 19 shows a side view of a motion-imparting time-lag representation of the production of the rectilinear lengthwise boundaries of the rectangular water distribution pattern. For clarity and simplicity, only the end-most nozzles are shown. As the rigid bifurcated oscillating tube (not shown) rotates from one horizontal-most position toward the vertical, the rigid, slick contact receptor 1904 on the flexible tube 1901 contacts and traverses the curved longitudinal angle regulator 1905. The longitudinally outward angle of the end-most nozzle is progressively decreased from horizontal-most to vertical, then is allowed to progressively increase from vertical to the second horizontal-most position. Thereby the rectilinear impact locations of water 1903 produce the rectilinear lengthwise boundaries 1902. All of the nozzles except the center nozzle are altered longitudinally throughout the oscillation cycle, thereby the evenly-spaced rectilinear impact locations of water may be produced throughout the length of the rectangular water distribution pattern. The number of degrees of change in the longitudinally outward angle of each nozzle increases as the nozzle's distance from the center nozzle increases.

In variations, a unitary grid may comprise side-to-side strengthening and reinforcing parts that may be located above and/or below the oscillating tube.

In variations, a unitary grid may be attached not only to the base structure, but also, if desired, to the "framework" of the sprinkler at and/or near the area of the water motor and/or to the "framework" at the distal end of the sprinkler.

In variations, all longitudinal and radial angle regulators need not be part of a unitary grid, but instead, some or all may be separate components, if so desired.

In variations, the "longitudinal angle regulators" adjacent to the center nozzle, on both sides of the center nozzle, may be omitted in as much as the center nozzle does not undergo any alteration or regulation of its longitudinal angle anyhow.

In variations, the arc formed in the vertical plane by the oscillation of a rigid, slick contact receptor on a flexible nozzle or a flexible tube may be an arc of the same size and shape, in the vertical plane, as that of the curved longitudinal angle regulator or the walls of the regulatory channel which it contacts. In variations, the arc of the curved longitudinal angle regulator in regard to its vertical plane, may be slightly different than the arc formed by the oscillation of the rigid, slick contact receptor, in which case frictional abrading or "wearing out" of the rigid, slick contact receptor may be reduced because the contact points may thereby be distributed through a vertical length of the surface of the rigid, slick contact receptor. The slightly differently shaped arcs thereby may take advantage of the available length of the rigid, slick contact receptors to increase their life span.

In variations, a rigid, slick contact receptor may comprise two parts. One part may fit securely onto the flexible nozzle while a second part may be a rotating wheel or rotating cylinder for example, which may roll along the curved longitudinal angle regulator or regulatory channel, instead of sliding along.

In variations, in regard to FIG. 17 for example, the center portion of the flexible tube 1703 which comes into contact with the radial angle regulator 1706, may have a rigid, slick contact receptor (not shown) configured to provide a contact surface where contact is made.

In variations, as an alternative to an embodiment generally depicted in FIGS. 3*a* through 12, there may be no rigid tube used. Instead, only a flexible tube somewhat similar to 602*b* may be used. In this case, there would not be any water-tight notched flange such as is described regarding 603*b* and 604*b*. In this case a relatively "strong," "thick-walled," oscillating tube may be made of the same material and formed "of the same mold," for example "of the same body," as the flexible nozzles. In this case, even though this body may be made of a single material, the thicknesses of the material may vary from part to part. For example, relatively thick material may constitute the generally cylindrically-round tube, and relatively thinner material may constitute various parts of the flexible nozzles. Thereby, the nozzles may be functionally flexible and have a definite longitudinal and radial angle. Thereby also, the tube may be substantial enough to attach to the sprinkler at its proximal and distal ends, and substantial enough to be attached to and driven by an oscillation mechanism at only one end, but not being deformed by twisting or torsion along its longitudinal length. If needed, simple and inexpensive rigid circumferential and/or longitudinal reinforcing components may be attached to the exterior of the flexible tube.

The manufacturer may choose from many options, alternatives, and variations available regarding the current invention. Also available are options, alternatives, and variations described in patent application Ser. No. 12/192,689 filed by the same applicant on Aug. 15, 2008, now U.S. Pat. No. 8,011,602 issued Sep. 6, 2011, entitled "Oscillating Sprinkler That Automatically Produces A Rectangular Water Distribution Pattern."

What is claimed is:

1. A sprinkler, comprising:

an oscillating tube that receives water from a supply, the tube rotationally oscillating about a longitudinal axis through a range of radial angles;

a plurality of nozzles spaced along the oscillating tube, the nozzles distributing water generally upward and outward from the oscillating tube to create a water distribution pattern on the ground, each nozzle directing water at a longitudinal angle with respect to the longitudinal axis; and a mechanism that automatically selectively regulates the longitudinal angles of at least some of the nozzles as a function of the radial angle of the oscillating tube, controlling the impact locations on the ground of the water emanating from the respective nozzles.

2. The sprinkler of claim 1, wherein the mechanism that automatically selectively regulates the longitudinal angles of at least some of the nozzles as a function of the radial angle of the oscillating tube regulates the longitudinal angles such that the water emanating from the respective nozzles reaches parallel, rectilinear, evenly-spaced impact locations on the ground.

3. The sprinkler of claim 2, wherein the water distribution pattern is rectangular or square.

4. The sprinkler of claim 2, wherein all of the nozzles receive full flow of water at all times during watering.

5. The sprinkler of claim 2, wherein the nozzles are long flexible nozzles extending from the oscillating tube, and wherein the mechanism that automatically selectively regulates the longitudinal angles of the nozzles as a function of the radial angle of the oscillating tube comprises:

a body disposed over and spaced from the oscillating tube, the body defining a plurality of regulatory channels through which the long flexible nozzles extend, at least some of the regulatory channels being curved so as to regulate the longitudinal angles of their respective nozzles to the extent needed to cause the water emanating from the nozzles to reach parallel, rectilinear, evenly-spaced impact locations on the ground.

6. The sprinkler of claim 5, wherein the lateral lengths of the regulatory channels are sized to automatically selectively restrict the ranges of radial angles traversed by at least some of the nozzles, such that the ends of the water distribution pattern are rectilinear.

7. The sprinkler of claim 2, wherein the nozzles are long flexible nozzles extending from the oscillating tube, and wherein the mechanism that automatically selectively regulates the longitudinal angles of the nozzles as a function of the radial angle of the oscillating tube comprises:

a plurality of curved angle regulators disposed over and spaced from the oscillating tube and along which at least some of the long flexible nozzles exert force during oscillation, the curved angle regulators being shaped so as to regulate the longitudinal angles of their respective nozzles to the extent needed to cause the water emanating from the nozzles to reach parallel, rectilinear, evenly-spaced impact locations on the ground.

8. The sprinkler of claim 7, further comprising two radial angle regulators that automatically selectively limit the radial travel of at least some of the nozzles such that the ends of the water distribution pattern are rectilinear.

9. The sprinkler of claim 2, wherein the oscillating tube is flexible and curved, and wherein the mechanism that automatically selectively regulates the longitudinal angles of the nozzles as a function of the radial angle of the oscillating tube comprises:

at least one curved angle regulator that contacts a portion of the oscillating tube during oscillation, regulating the curvature of the oscillating tube as a function of the radial angle of the oscillating tube and consequently regulating the longitudinal angles of the nozzles to the extent needed to cause the water emanating from the nozzles to reach parallel, rectilinear, evenly-spaced impact locations on the ground.

10. The sprinkler of claim 9, further comprising two radial angle regulators that restrict the radial travel of at least a portion of the tube, automatically restricting the range of radial angles traversed by at least some of the nozzles such that the ends of the water distribution pattern are rectilinear.

11. A method of automatically producing a water distribution pattern, the method comprising:

providing a supply of water to a tube, the tube comprising a plurality of nozzles that direct the water generally upward and outward from the tube;

oscillating the tube rotationally about a longitudinal axis through a range of radial angles to create a water distribution pattern on the ground, each nozzle directing water at a longitudinal angle with respect to the longitudinal axis; and automatically selectively regulating the longitudinal angles of at least some of the nozzles as a function of the radial angle of the oscillating tube, to control the impact locations on the ground of the water emanating from the respective nozzles.

12. The method of claim 11, wherein automatically selectively regulating the longitudinal angles of at least some of the nozzles as a function of the radial angle of the oscillating tube comprises regulating the longitudinal angles such that the water emanating from the respective nozzles reaches parallel, rectilinear, evenly-spaced impact locations on the ground.

13. The method of claim 12, wherein the water distribution pattern is rectangular or square.

14. The method of claim 12, wherein all of the nozzles receive full flow of water at all times during watering.

15. The method of claim 12, wherein the nozzles are long flexible nozzles extending from the oscillating tube, and wherein the method further comprises:

providing a body disposed over and spaced from the oscillating tube, the body defining a plurality of regulatory channels through which the long flexible nozzles extend, at least some of the regulatory channels being curved; and automatically guiding the long flexible nozzles using the regulatory channels so as to regulate the longitudinal angles of the respective nozzles to the extent needed to cause the water emanating from the nozzles to reach parallel, rectilinear, evenly-spaced impact locations on the ground.

16. The method of claim 15, further comprising automatically selectively restricting the ranges of radial angles traversed by at least some of the nozzles by selection of the lengths of the regulatory channels such that the ends of the water distribution pattern are rectilinear.

17. The method of claim 12, wherein the nozzles are long flexible nozzles extending from the oscillating tube, and wherein the method further comprises:

providing a plurality of curved angle regulators disposed over and spaced from the oscillating tube and along which at least some of the long flexible nozzles exert force during oscillation; and guiding the long flexible nozzles using the curved angle regulators so as to regulate the longitudinal angles of the respective nozzles to the extent needed to cause the water emanating from the nozzles to reach parallel, rectilinear, evenly-spaced impact locations on the ground.

18. The method of claim 17, further comprising:

providing two radial angle regulators; and automatically selectively limiting the radial travel of at least some of the nozzles using the radial angle regulators such that the ends of the water distribution pattern are rectilinear.

19. The method of claim 12, wherein the tube is curved and flexible, and wherein the method further comprises:

providing at least one curved angle regulator that contacts a portion of the oscillating tube during oscillation; and automatically regulating the curvature of the oscillating tube as a function of the radial angle of the oscillating tube by the contact of the tube with the curved angle regulator, and consequently regulating the longitudinal angles of the nozzles to the extent needed to cause the water emanating from the nozzles to reach parallel, rectilinear, evenly-spaced impact locations on the ground.

20. The method of claim 19, further comprising:

providing two radial angle regulators; and automatically selectively limiting the radial travel of at least part of the tube using the radial angle regulators, restricting the range of radial angles traversed by at least some of the nozzles such that the ends of the water distribution pattern are rectilinear.

21. A sprinkler, comprising:

an oscillating tube that receives water from a supply, the tube rotationally oscillating about a longitudinal axis through a range of radial angles;

a plurality of flexible nozzles extending from the oscillating tube and spaced along the oscillating tube, the nozzles distributing water generally upward and outward from the oscillating tube to create a water distribution pattern on the ground, each nozzle directing water at a longitudinal angle with respect to the longitudinal axis; and a mechanism that automatically selectively restricts the ranges of radial angles traversed by at least some of the nozzles, such that the ends of the water distribution pattern are rectilinear.

22. The sprinkler of claim 21, further comprising a body disposed over and spaced from the oscillating tube, the body defining a plurality of regulatory channels through which the long flexible nozzles extend, wherein the lateral lengths of the regulatory channels are sized to automatically selectively restrict the ranges of radial angles traversed by at least some of the nozzles.

23. The sprinkler of claim 21, further comprising two radial angle regulators that automatically selectively limit the radial travel of at least some of the nozzles such that the ends of the water distribution pattern are rectilinear.

* * * * *